US011431098B2

(12) United States Patent
Wu et al.

(10) Patent No.: US 11,431,098 B2
(45) Date of Patent: Aug. 30, 2022

(54) PHASE CONTROL DEVICE, ANTENNA SYSTEM, AND PHASE CONTROL METHOD

(71) Applicant: NEC CORPORATION, Tokyo (JP)

(72) Inventors: Mingqi Wu, Tokyo (JP); Keishi Kosaka, Tokyo (JP); Eiji Hankui, Tokyo (JP)

(73) Assignee: NEC CORPORATION, Tokyo (JP)

( * ) Notice: Subject to any disclaimer, the term of this patent is extended or adjusted under 35 U.S.C. 154(b) by 12 days.

(21) Appl. No.: 17/052,605

(22) PCT Filed: Jun. 28, 2018

(86) PCT No.: PCT/JP2018/024549

§ 371 (c)(1),
(2) Date: Nov. 3, 2020

(87) PCT Pub. No.: WO2020/003432

PCT Pub. Date: Jan. 2, 2020

(65) Prior Publication Data

US 2021/0257742 A1 Aug. 19, 2021

(51) Int. Cl.

| | |
|---|---|
| ***H01Q 3/46*** | (2006.01) |
| ***H01Q 15/00*** | (2006.01) |
| ***H01Q 19/06*** | (2006.01) |

(52) U.S. Cl.

CPC ..... *H01Q 15/002* (2013.01); *H01Q 3/46* (2013.01); *H01Q 19/062* (2013.01)

(58) Field of Classification Search

CPC .... H01Q 15/002; H01Q 15/0013; H01Q 3/46; H01Q 19/062

See application file for complete search history.

(56) References Cited

U.S. PATENT DOCUMENTS 8,803,738 B2 8/2014 Nguyen et al.
9,583,839 B2 * 2/2017 Liu ..... H01Q 15/0026

(Continued)

FOREIGN PATENT DOCUMENTS

JP 2010-268216 A 11/2010
JP 2017-069677 A 4/2017

(Continued)

OTHER PUBLICATIONS

International Search Report for PCT/JP2018/024549 dated Sep. 4, 2018 [PCT/ISA/210].

(Continued)

*Primary Examiner* — Awat M Salih

(57) ABSTRACT

An object is to advantageously control a phase of an electromagnetic wave with high efficiency at target operational frequency band. A phase control device (10) comprising a two-dimensional array of three-dimensional units (101) and configured to shift a phase of an electromagnetic wave passing through the three-dimensional units (101). The two nearest three-dimensional units (101) having same phase shift coverage are configured such that the distance difference from phase center of the phase control device (10) to the units (101) is a wavelength of a reference frequency $f_k$, and the reference frequency $f_k$ is higher than center frequency $f_c$ of operational frequency band and not higher than the highest frequency $f_h$ of the operational frequency band.

12 Claims, 24 Drawing Sheets

(56) References Cited

U.S. PATENT DOCUMENTS

| | | | | |
|---|---|---|---|---|
| 2015/0200452 | A1* | 7/2015 | Oh | H01Q 19/062 343/754 |
| 2016/0361002 | A1* | 12/2016 | Palikaras | A61B 5/0507 |
| 2017/0062945 | A1 | 3/2017 | Foo | |
| 2018/0316090 | A1* | 11/2018 | Foo | H01Q 19/062 |
| 2019/0260135 | A1* | 8/2019 | Kasahara | H01Q 13/10 |

FOREIGN PATENT DOCUMENTS

| | | | |
|---|---|---|---|
| WO | 2015/128657 | A1 | 9/2015 |
| WO | 2017/091845 | A1 | 6/2017 |

OTHER PUBLICATIONS

Written Opinion for PCT/JP2018/024549 dated Sep. 4, 2018 [PCT/ISA/237].

* cited by examiner

[Fig. 1]
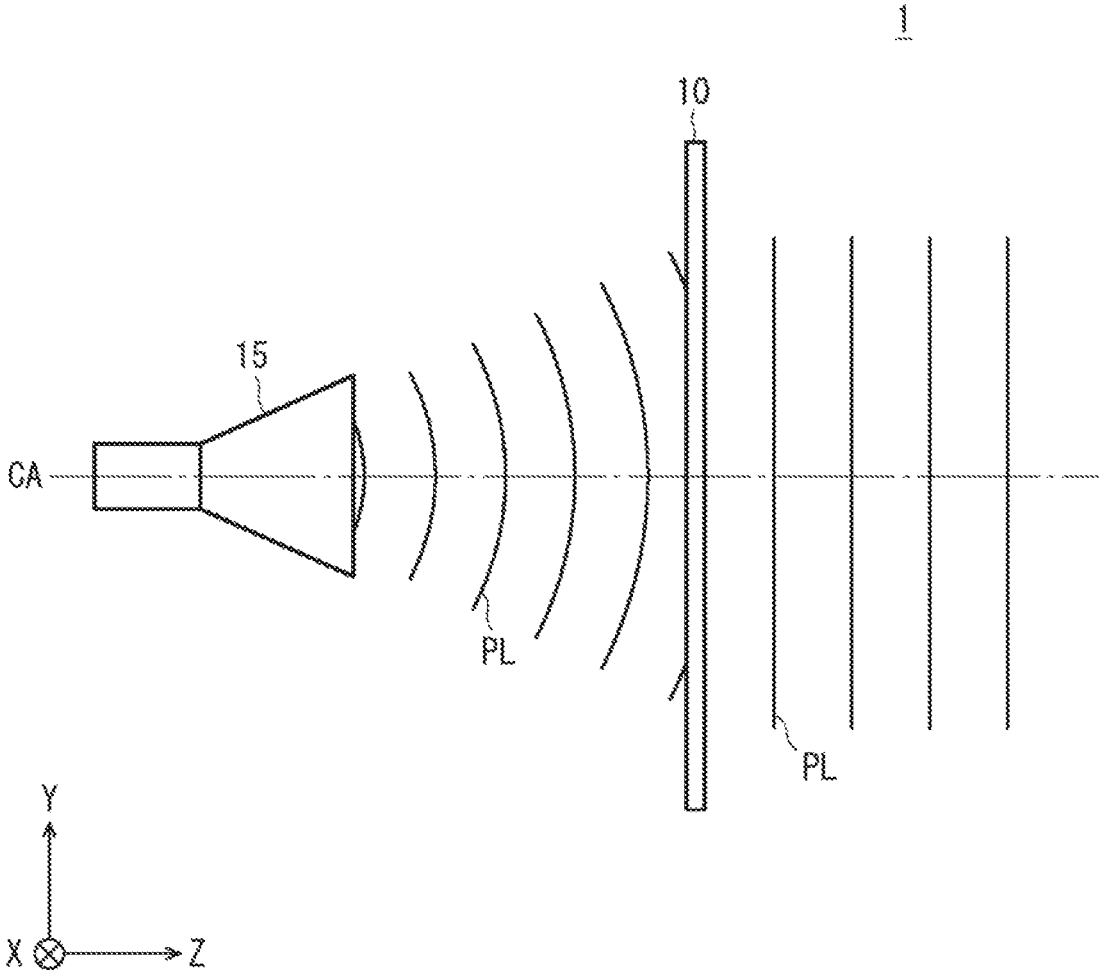

[Fig. 2]
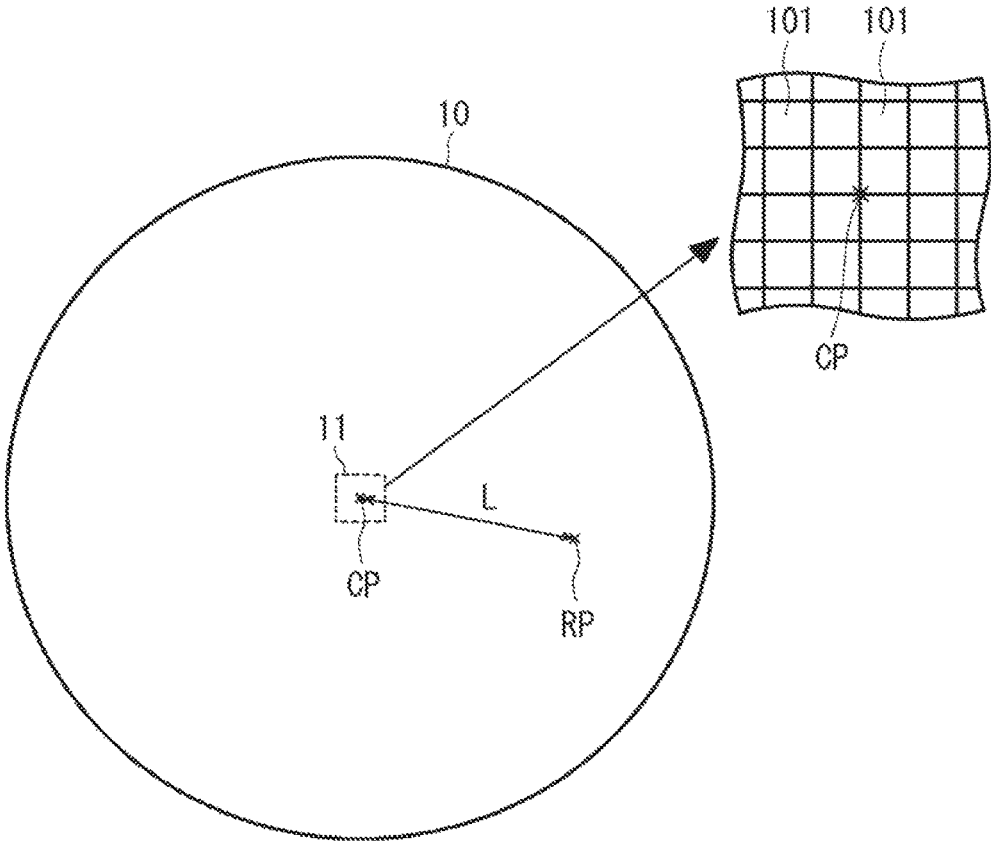
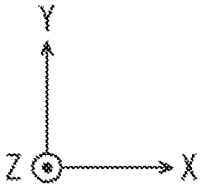
[Fig. 3]
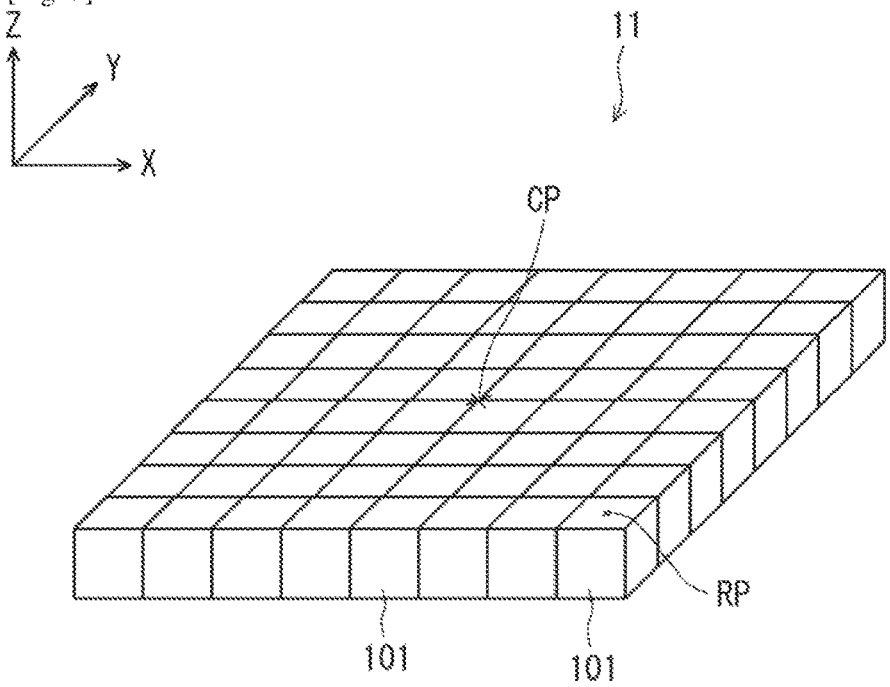

[Fig. 4]
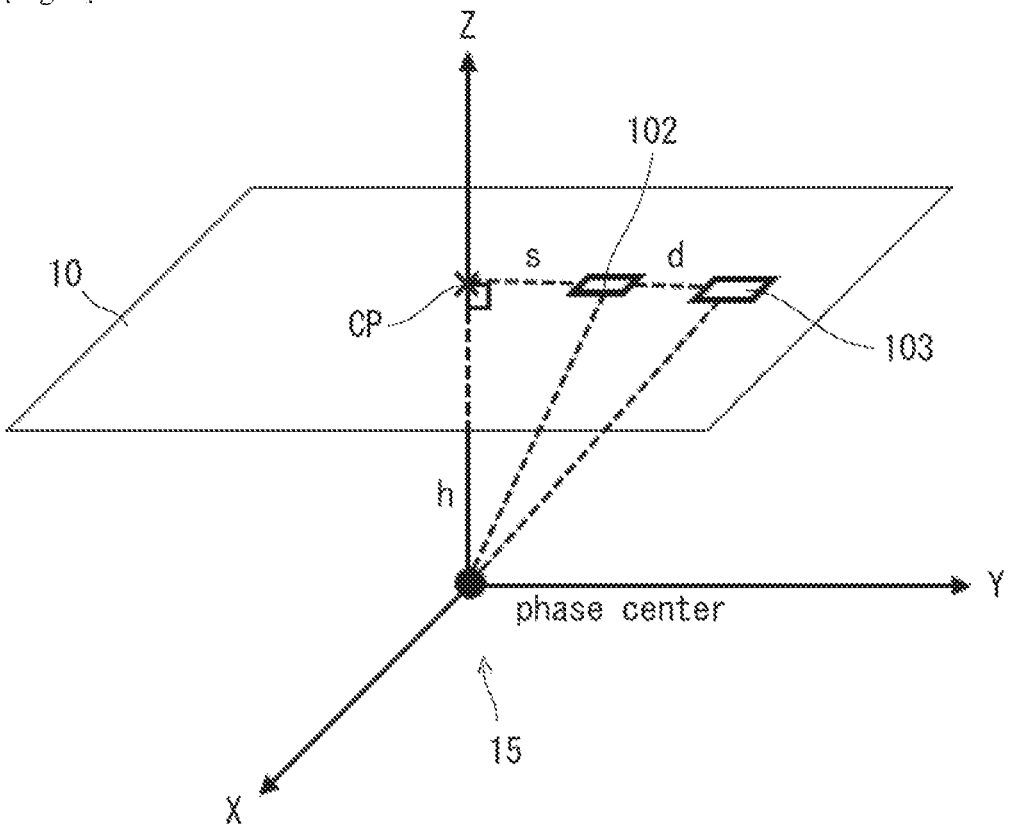
[Fig. 5]
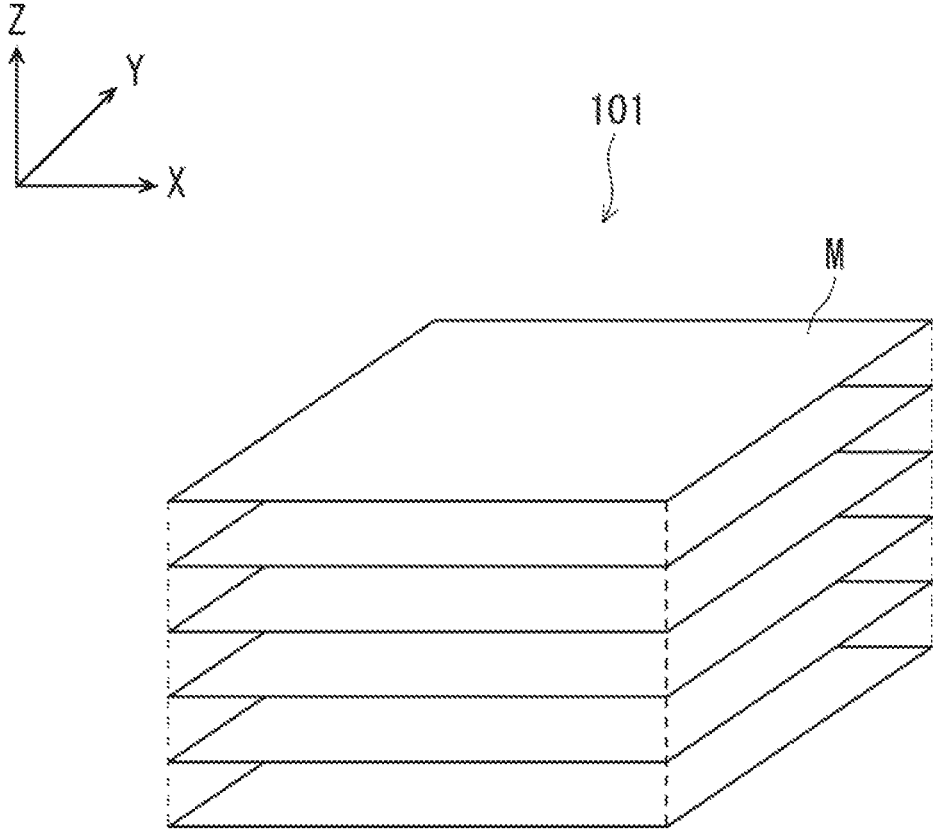

[Fig. 6]
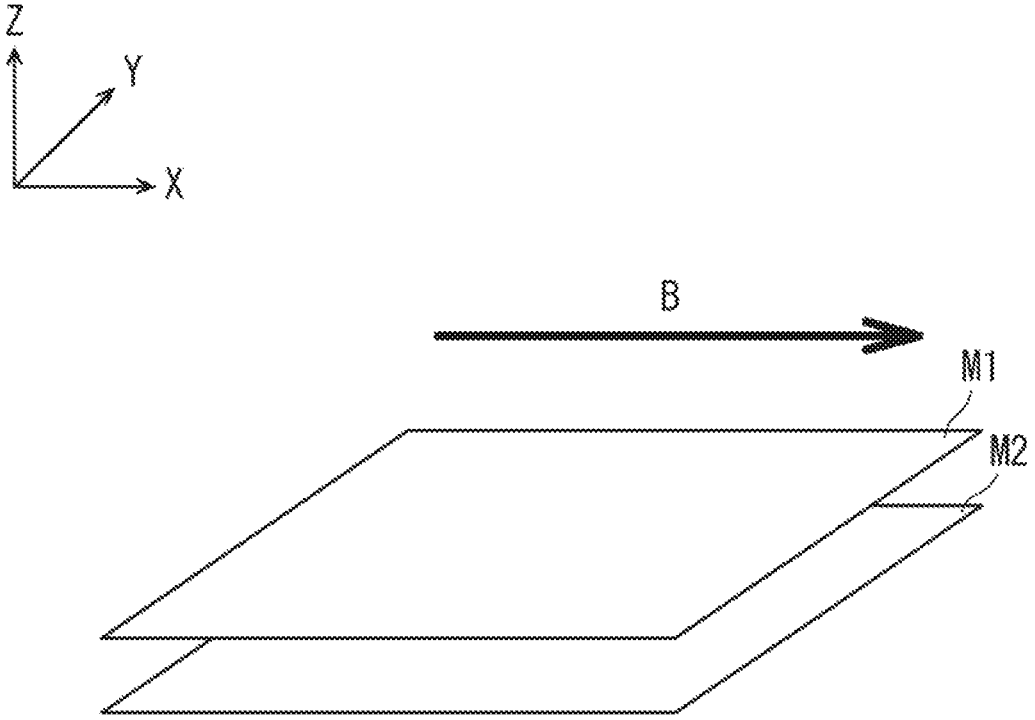
[Fig. 7]
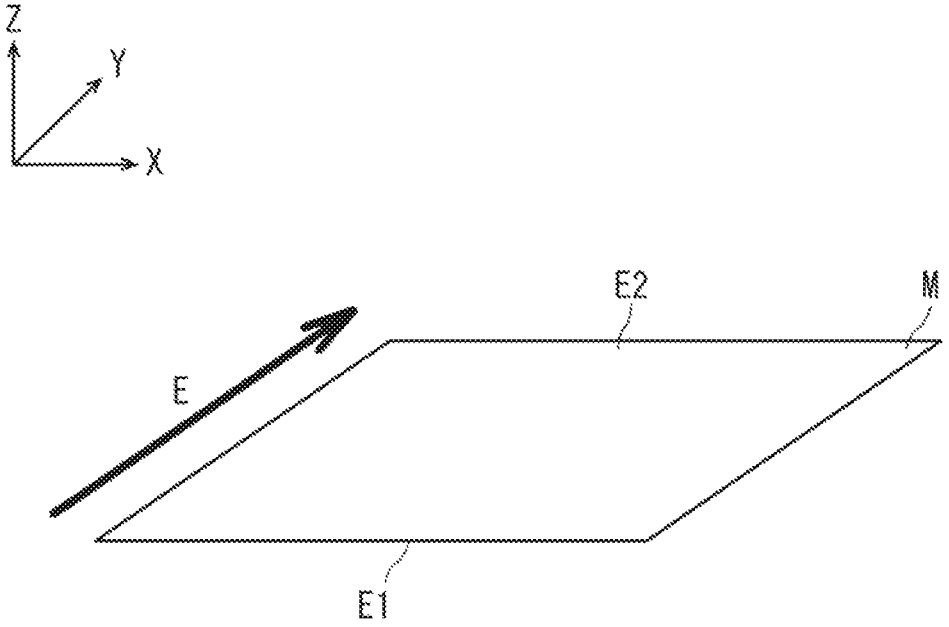

[Fig. 8]
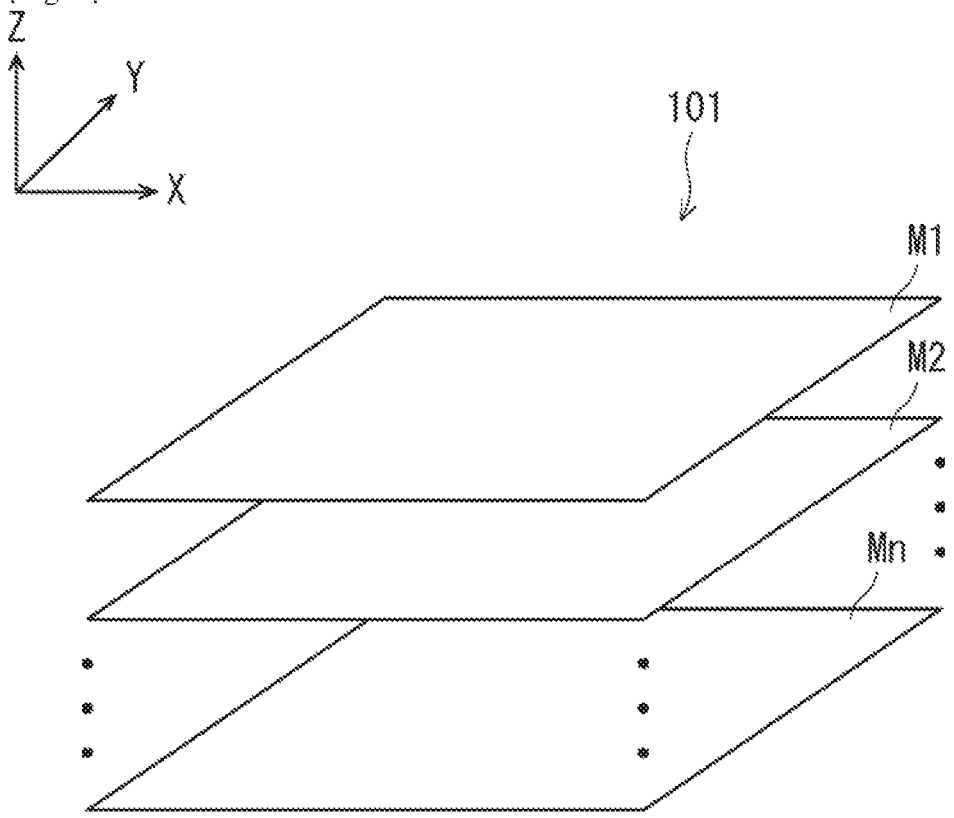
[Fig. 9]
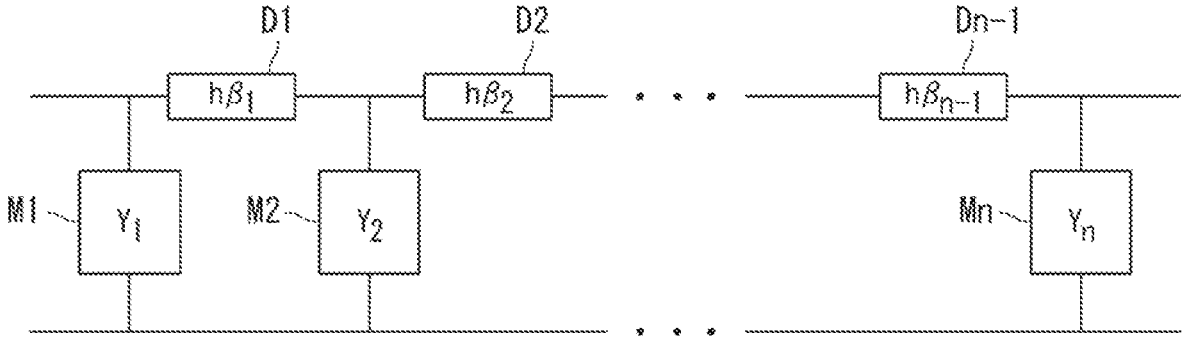

[Fig. 10]
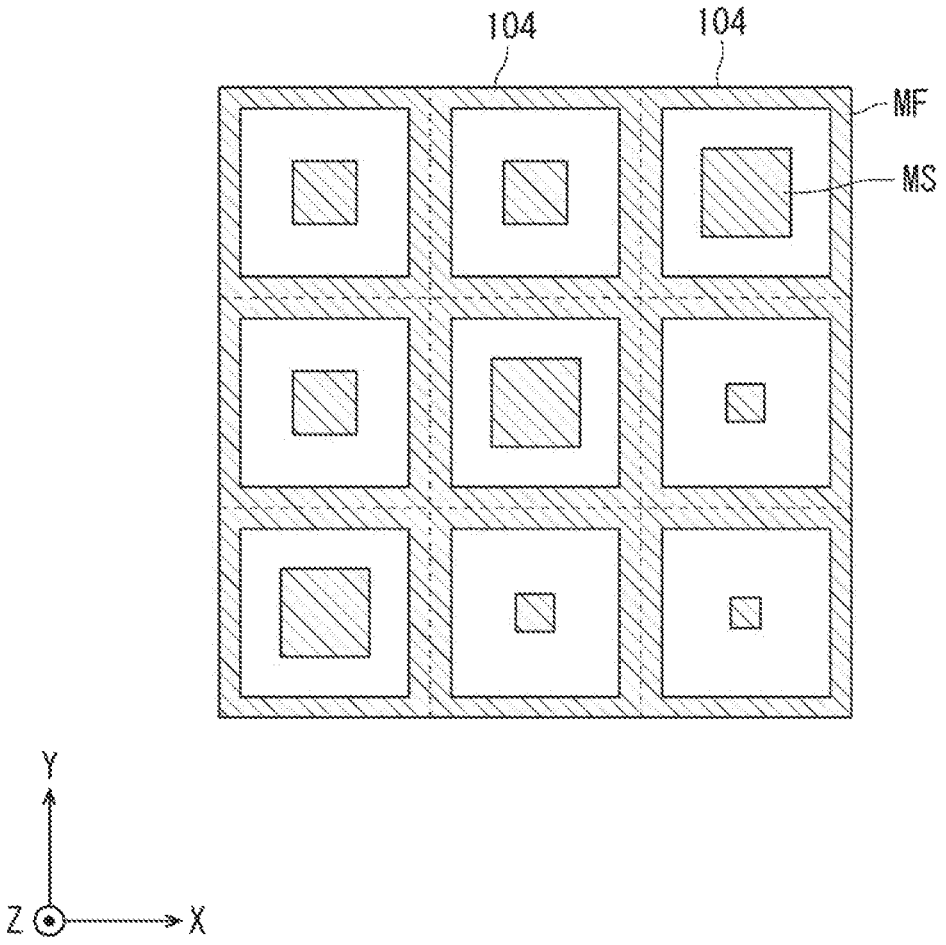

[Fig. 11]
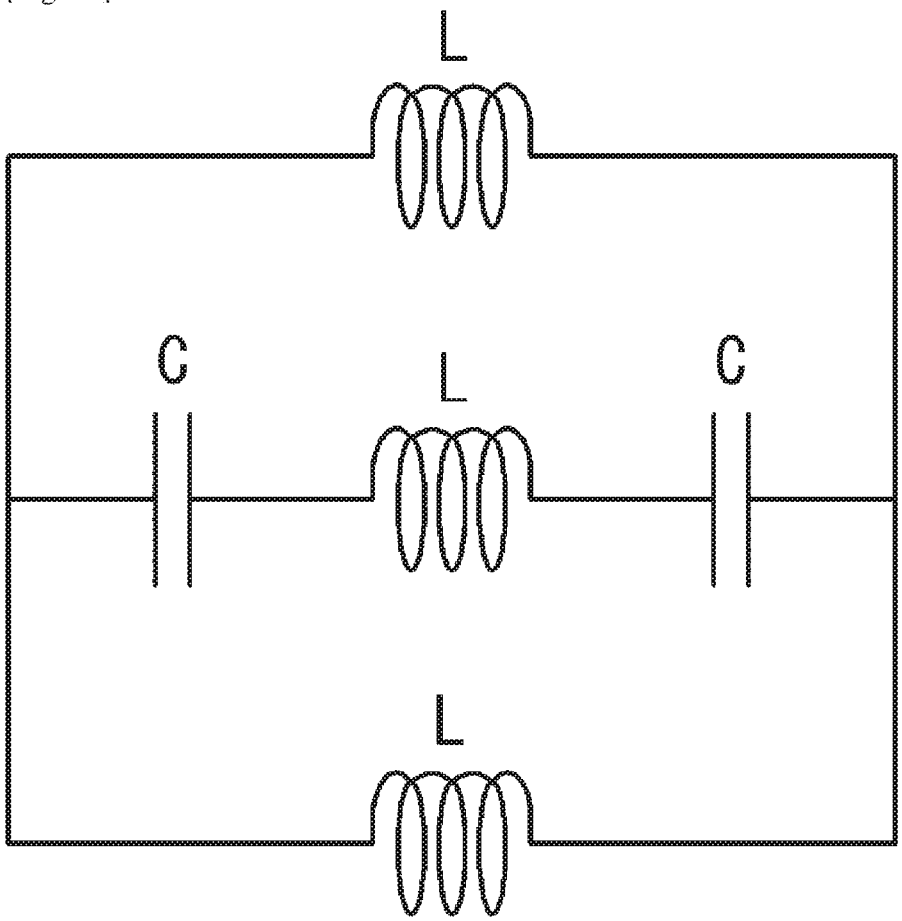

[Fig. 12]
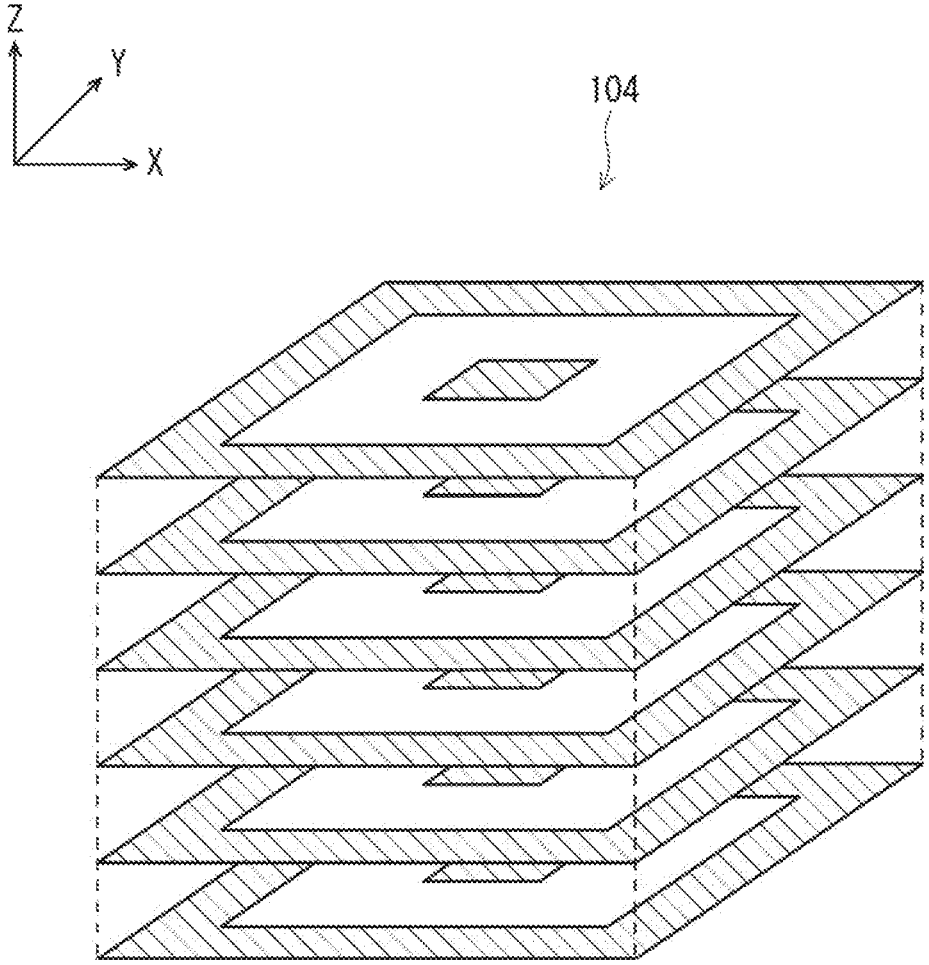

[Fig. 13]
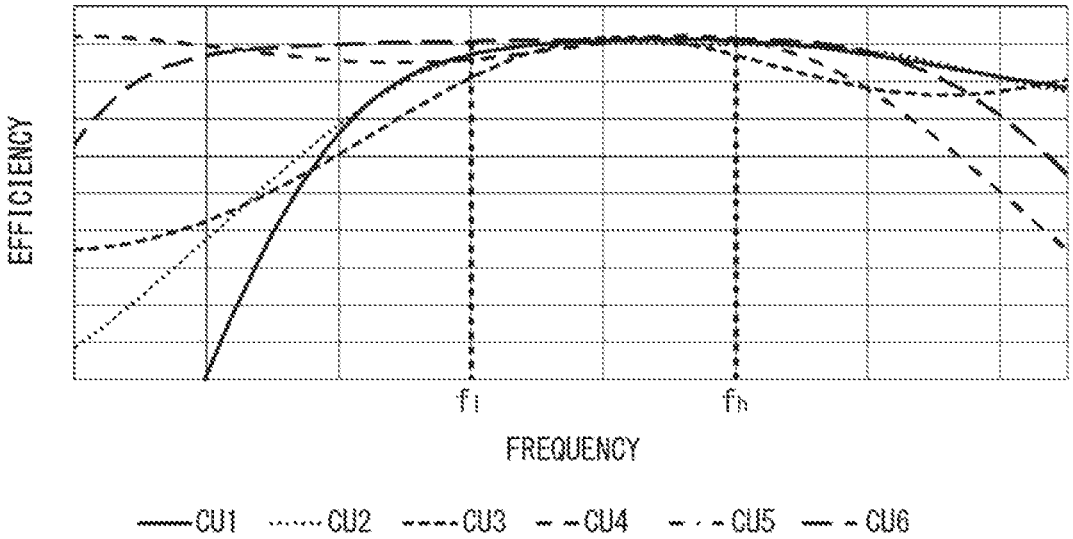
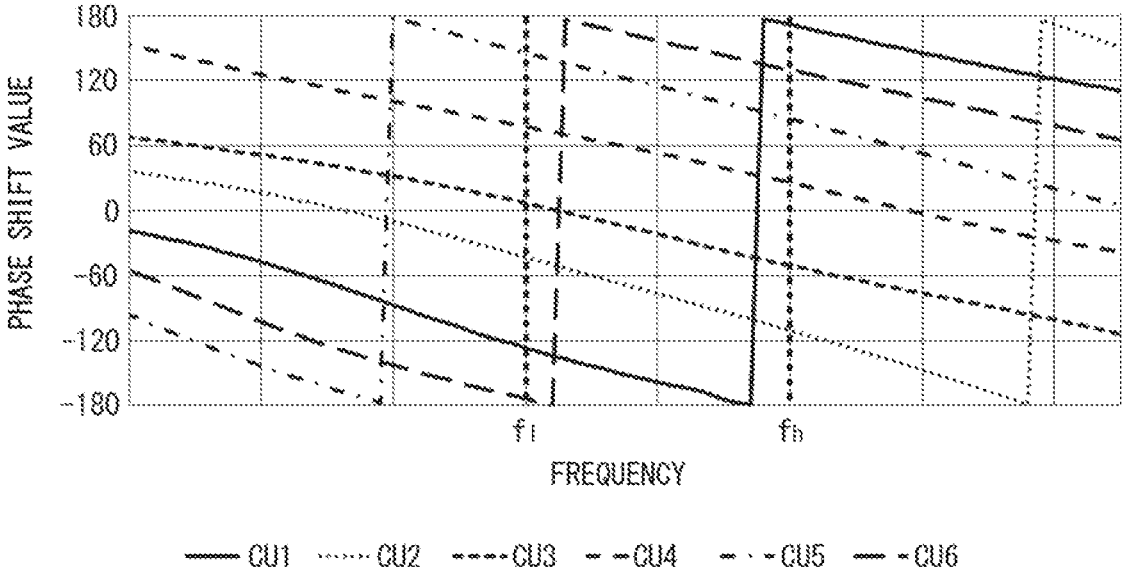

[Fig. 14]
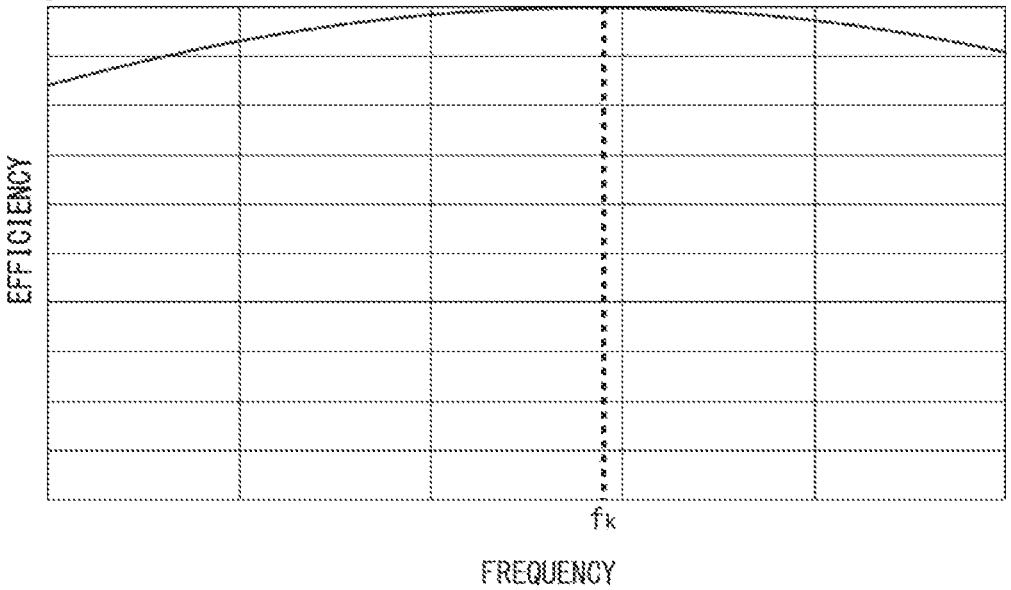
[Fig. 15]
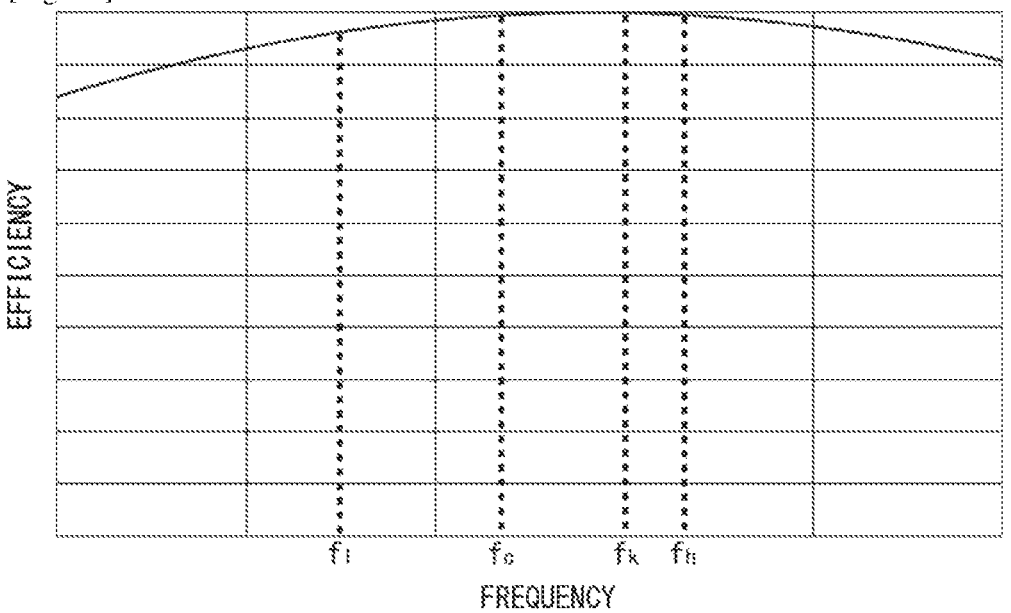

[Fig. 16]
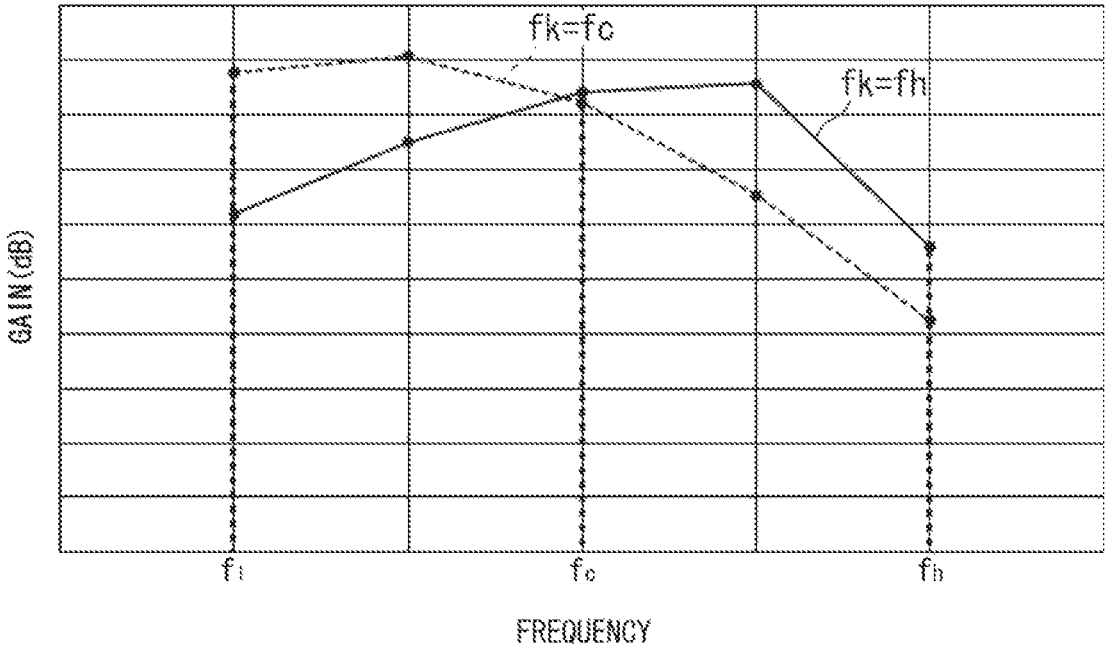

[Fig. 17]
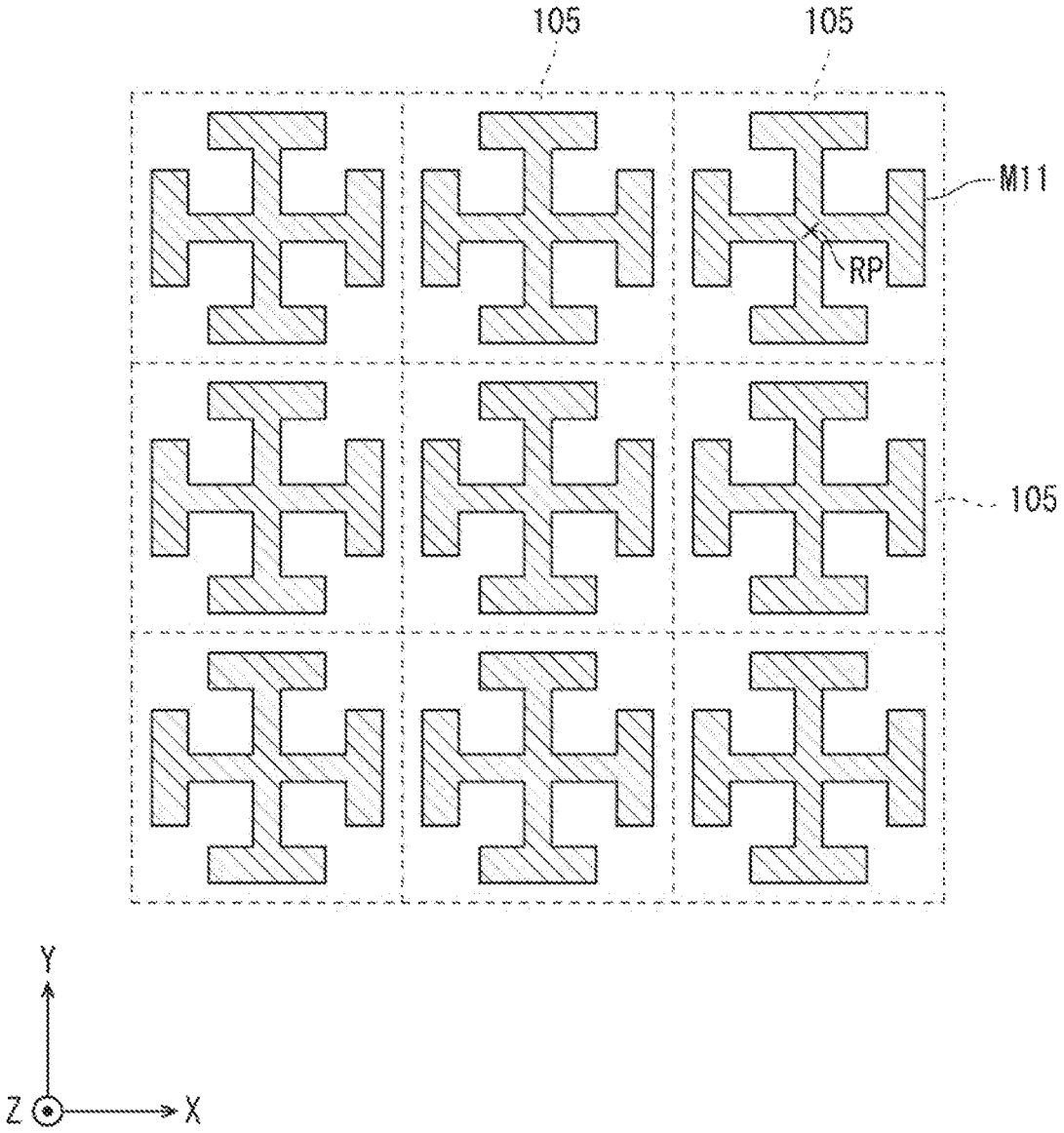

[Fig. 18]
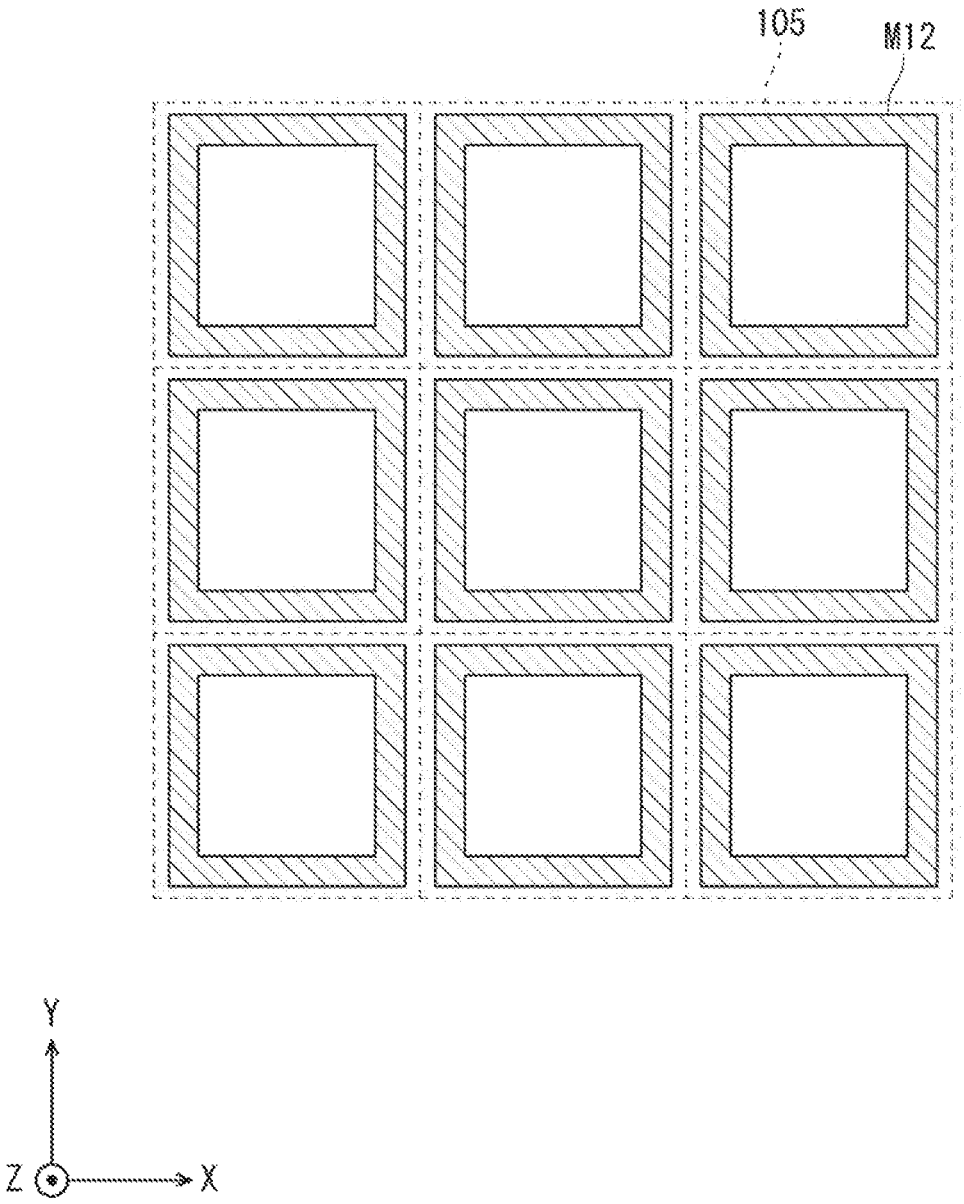

[Fig. 19]
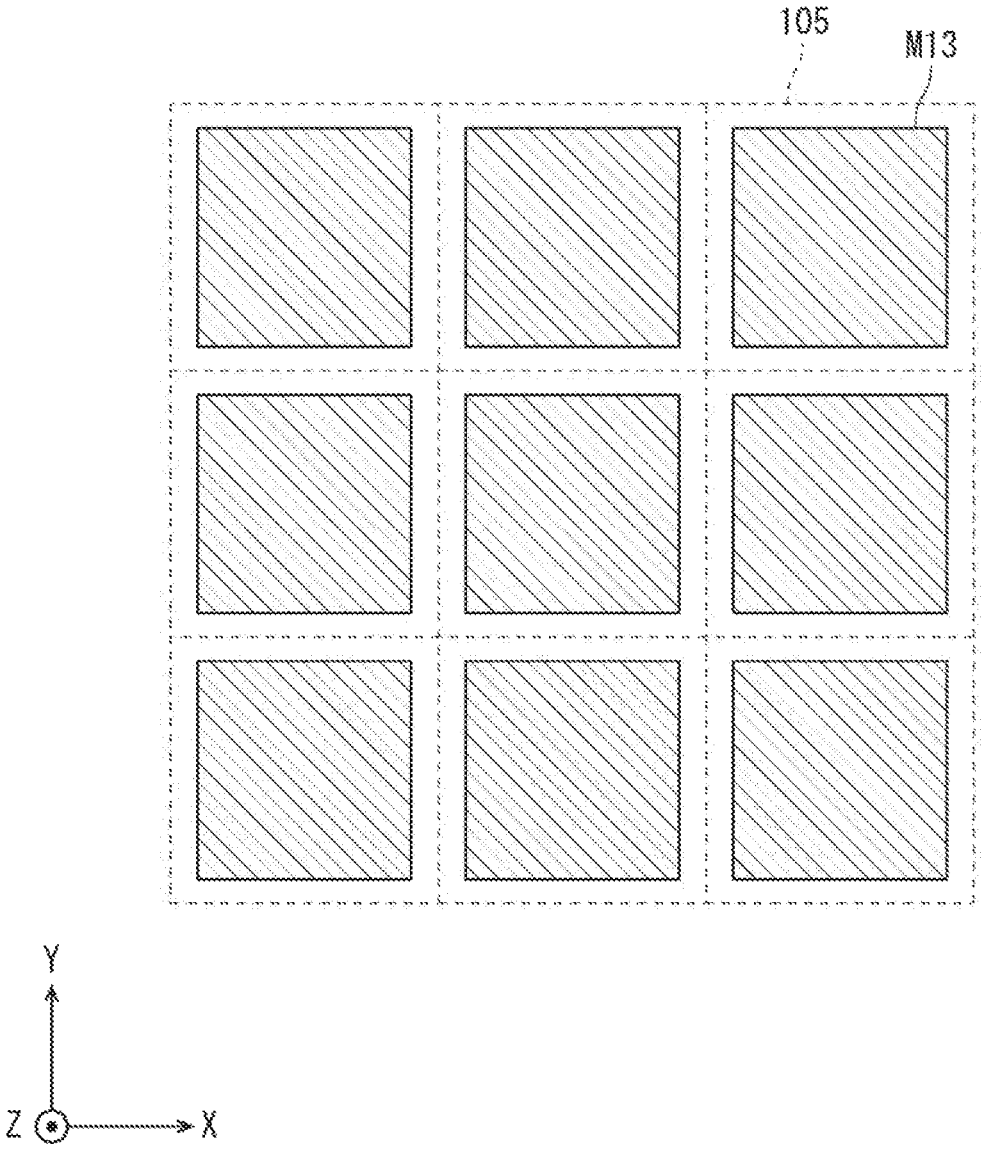

[Fig. 20]
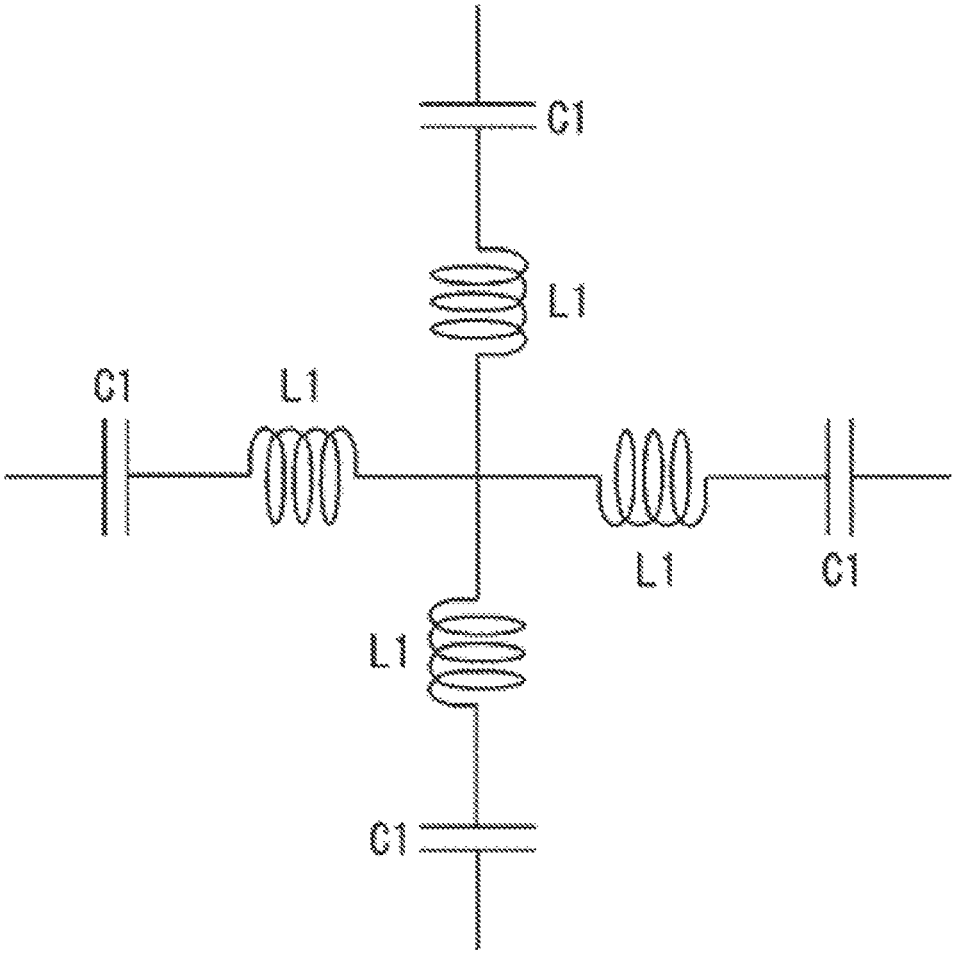

[Fig. 21]
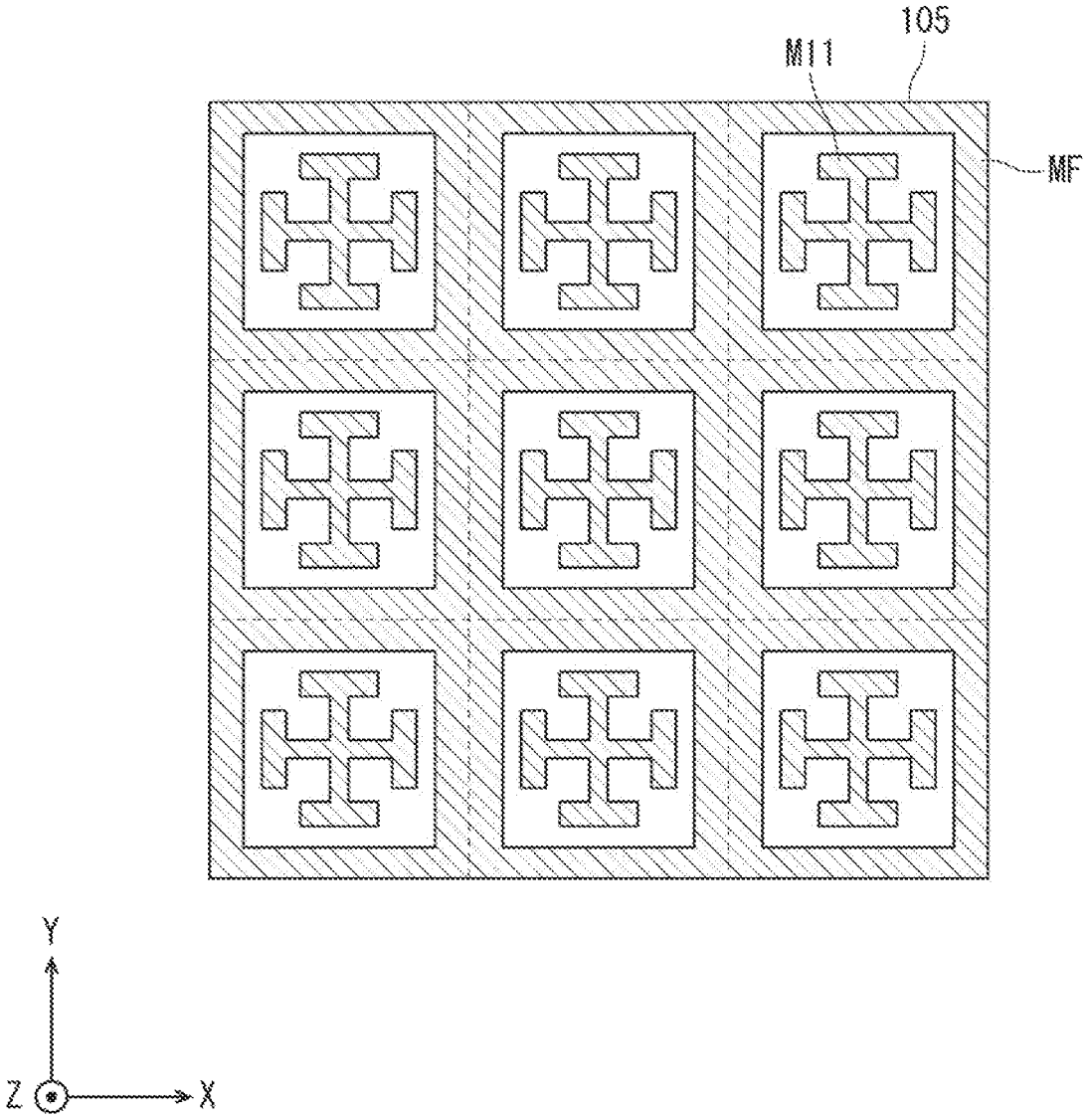

[Fig. 22]
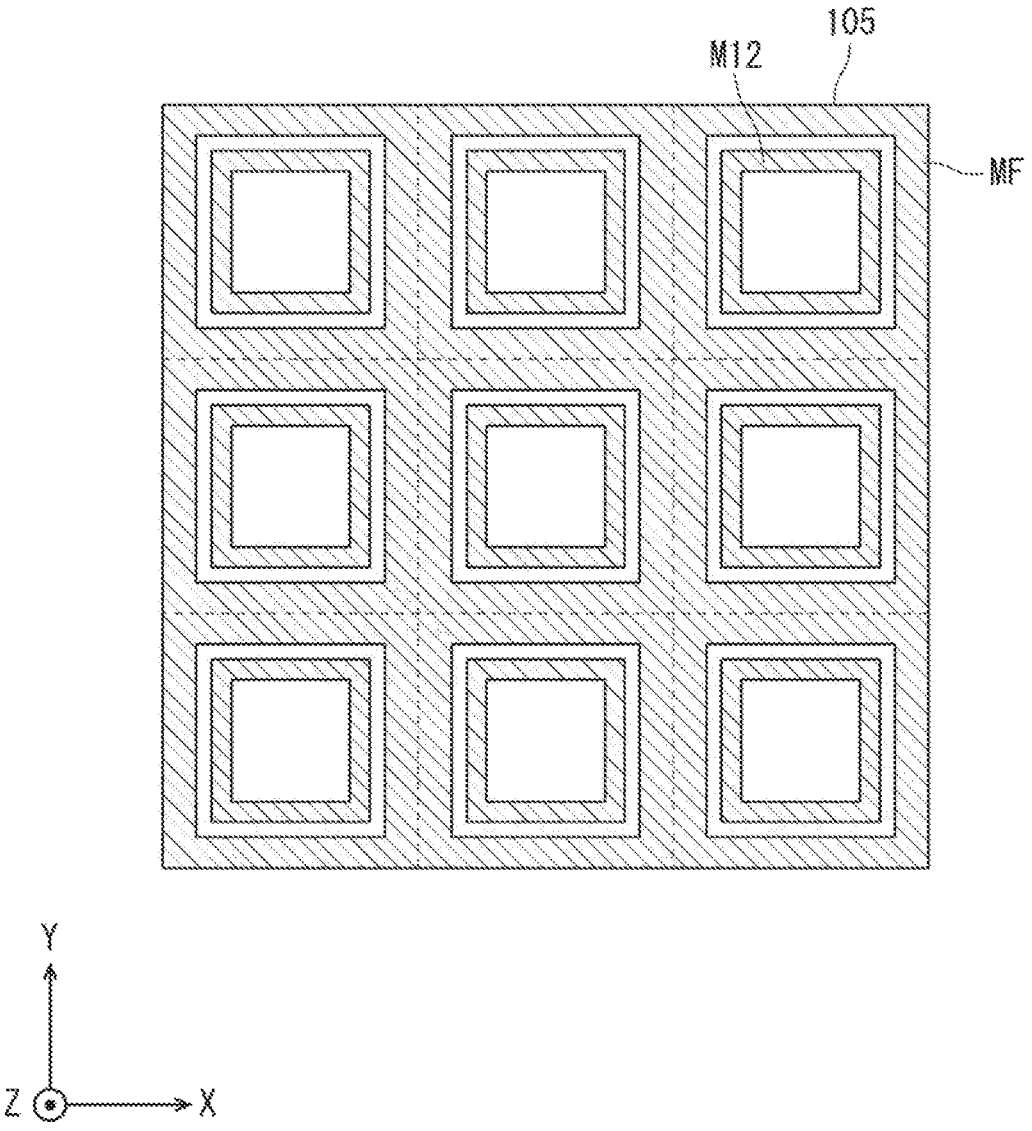

[Fig. 23]
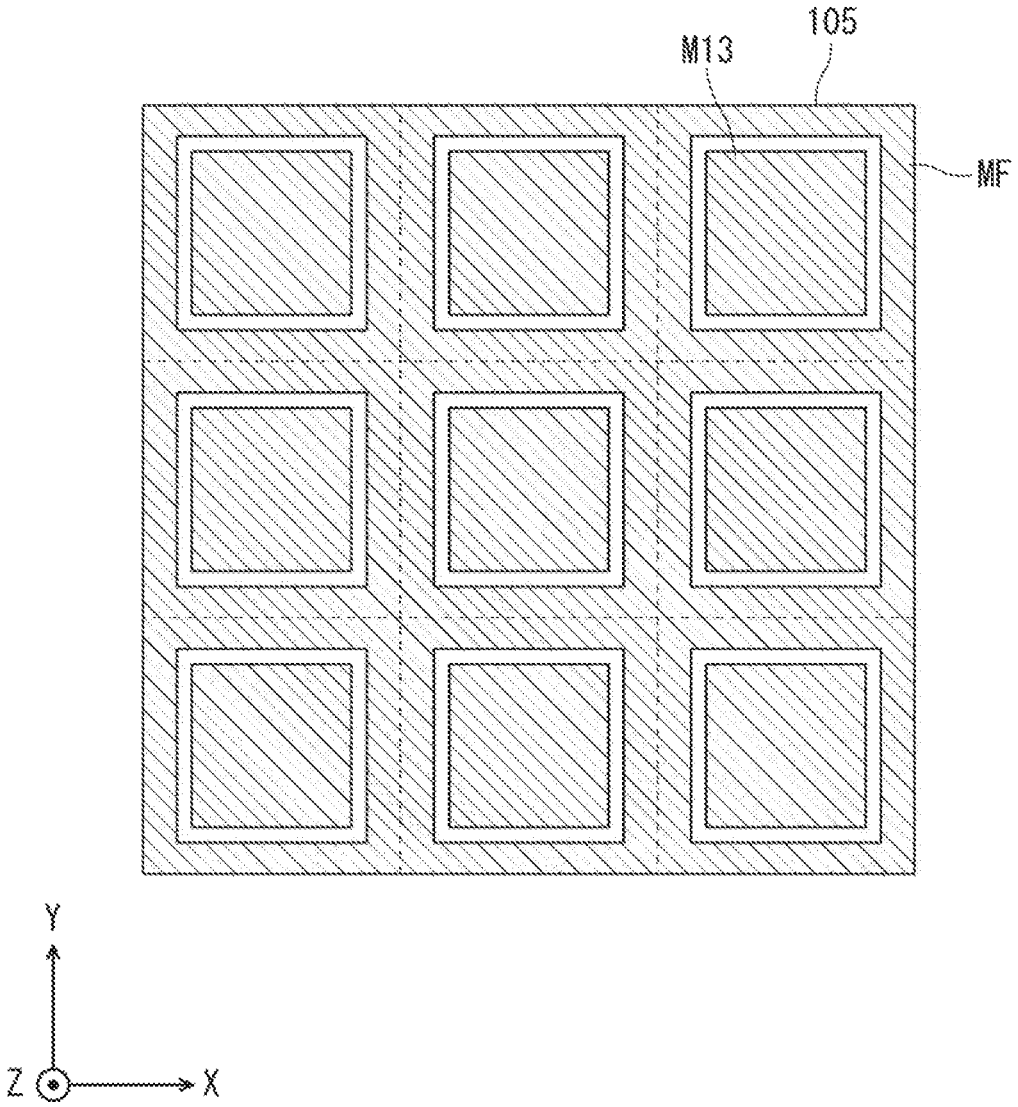

[Fig. 24]
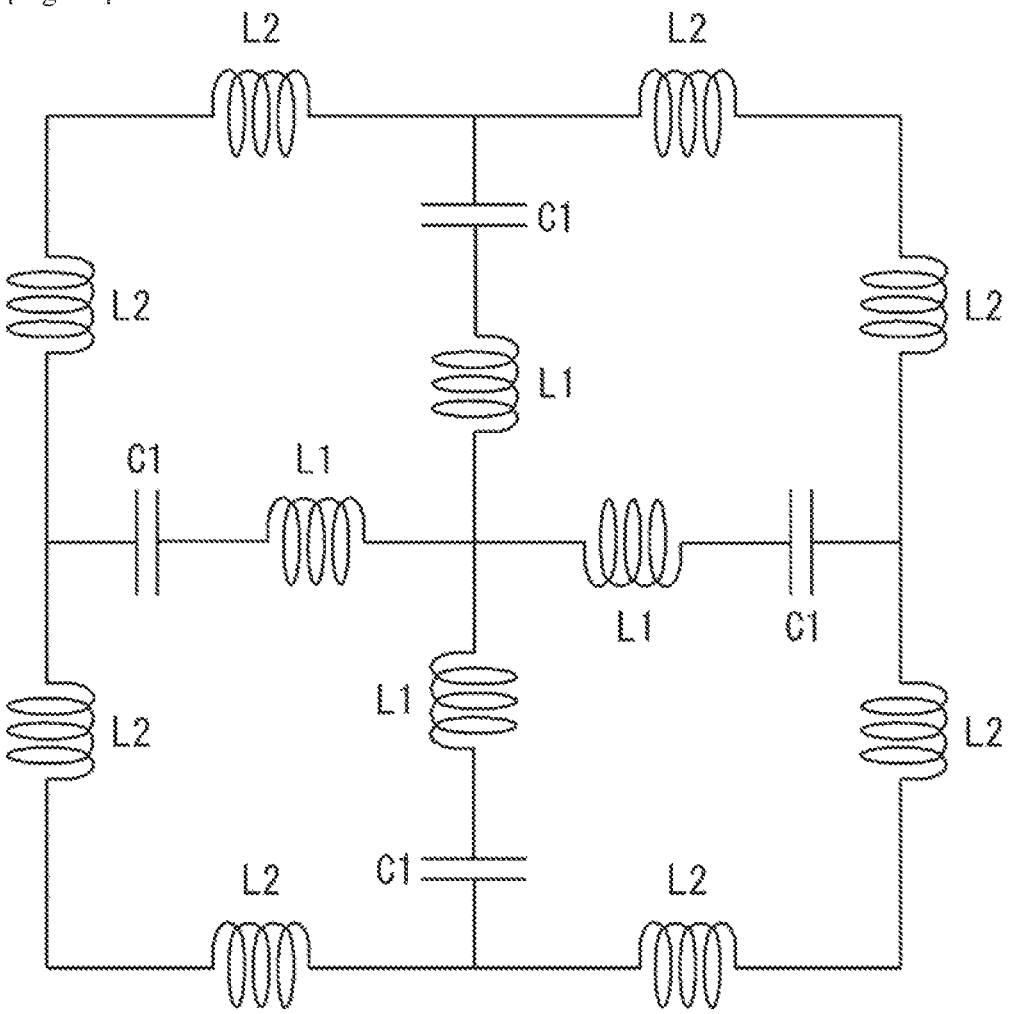

[Fig. 25]
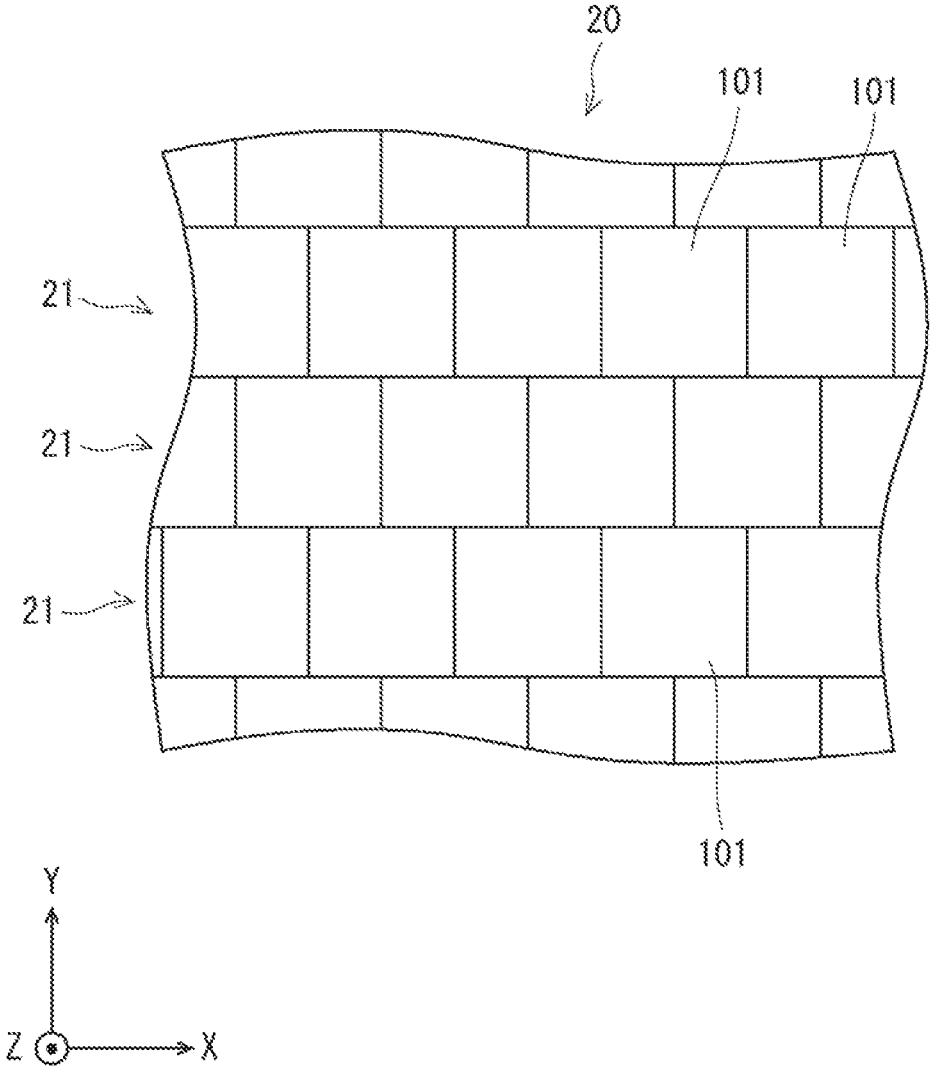

[Fig. 26]
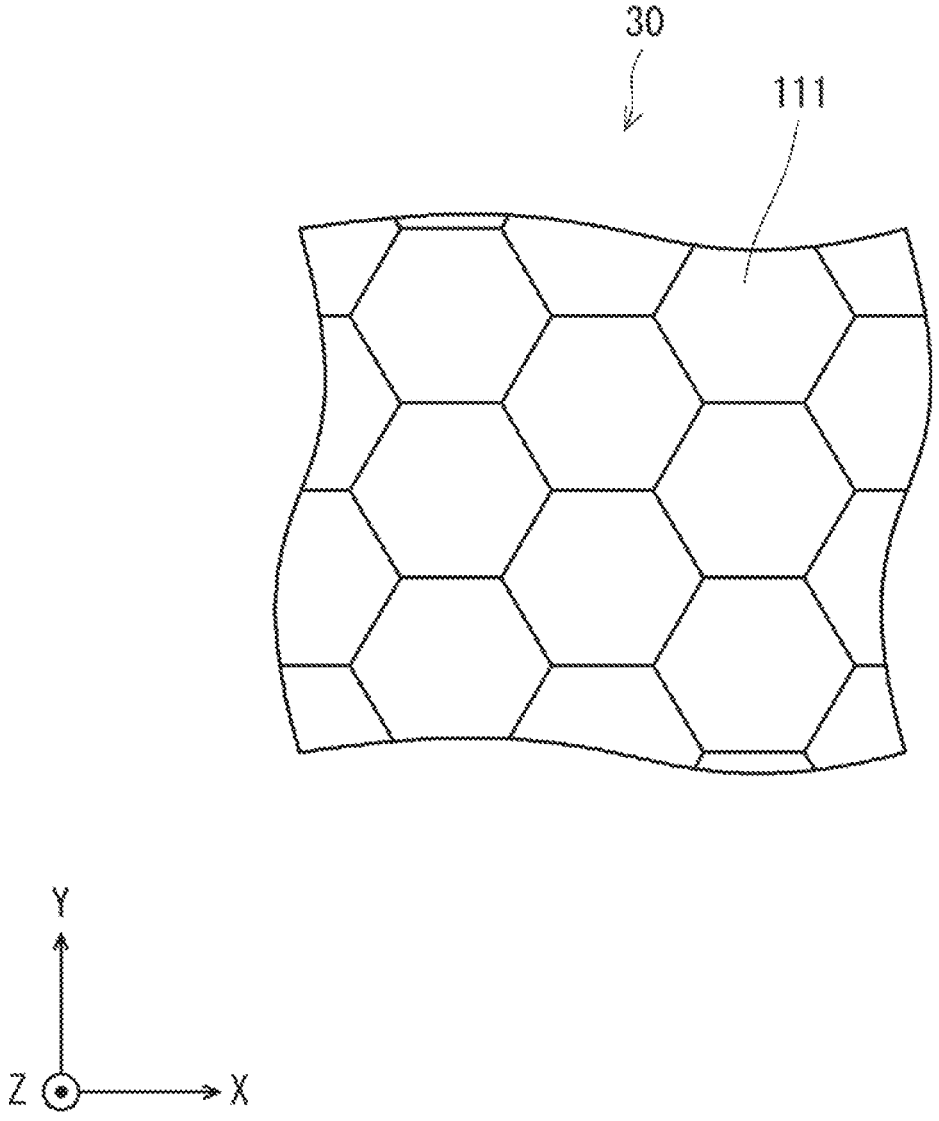

[Fig. 27]
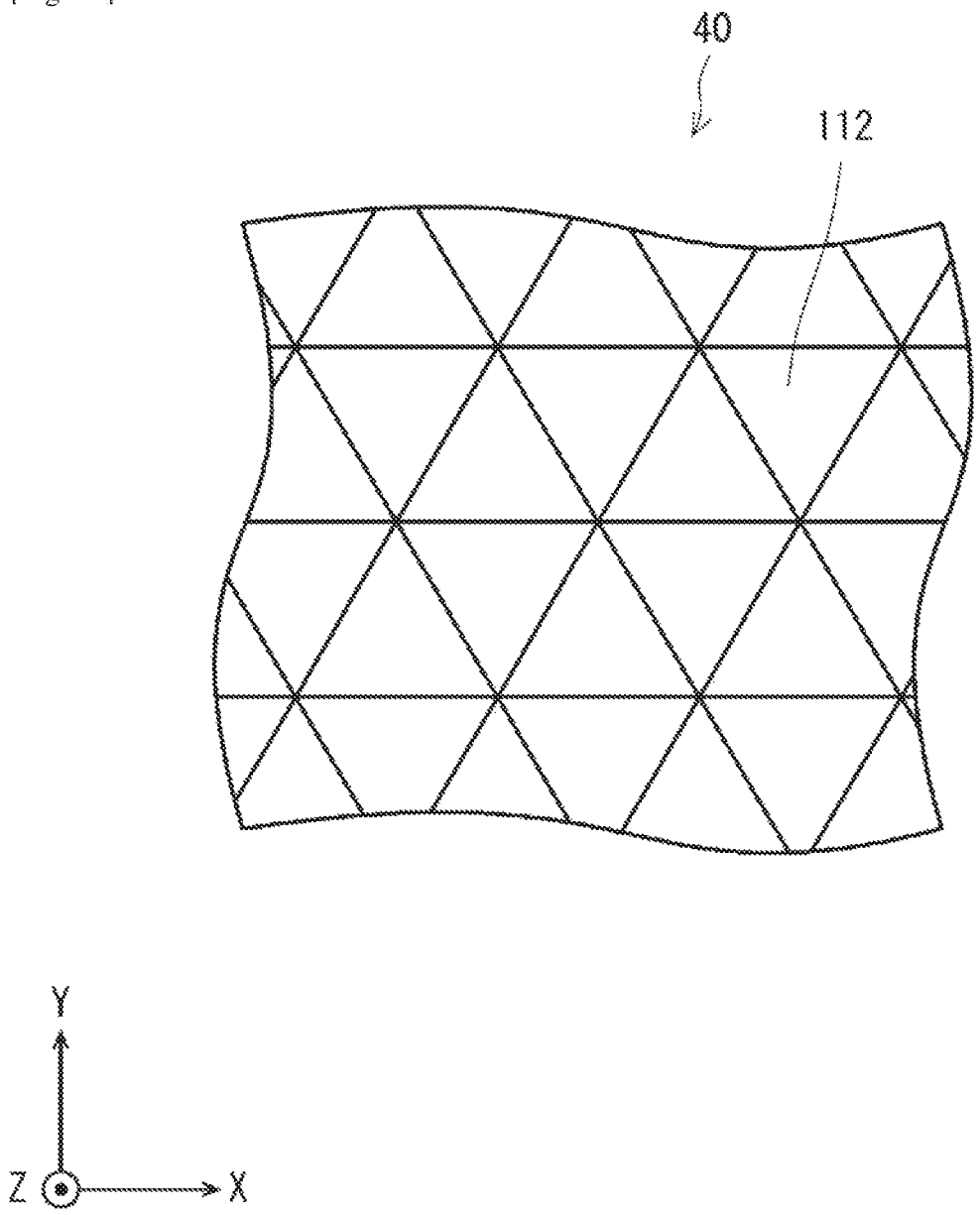

[Fig. 28]
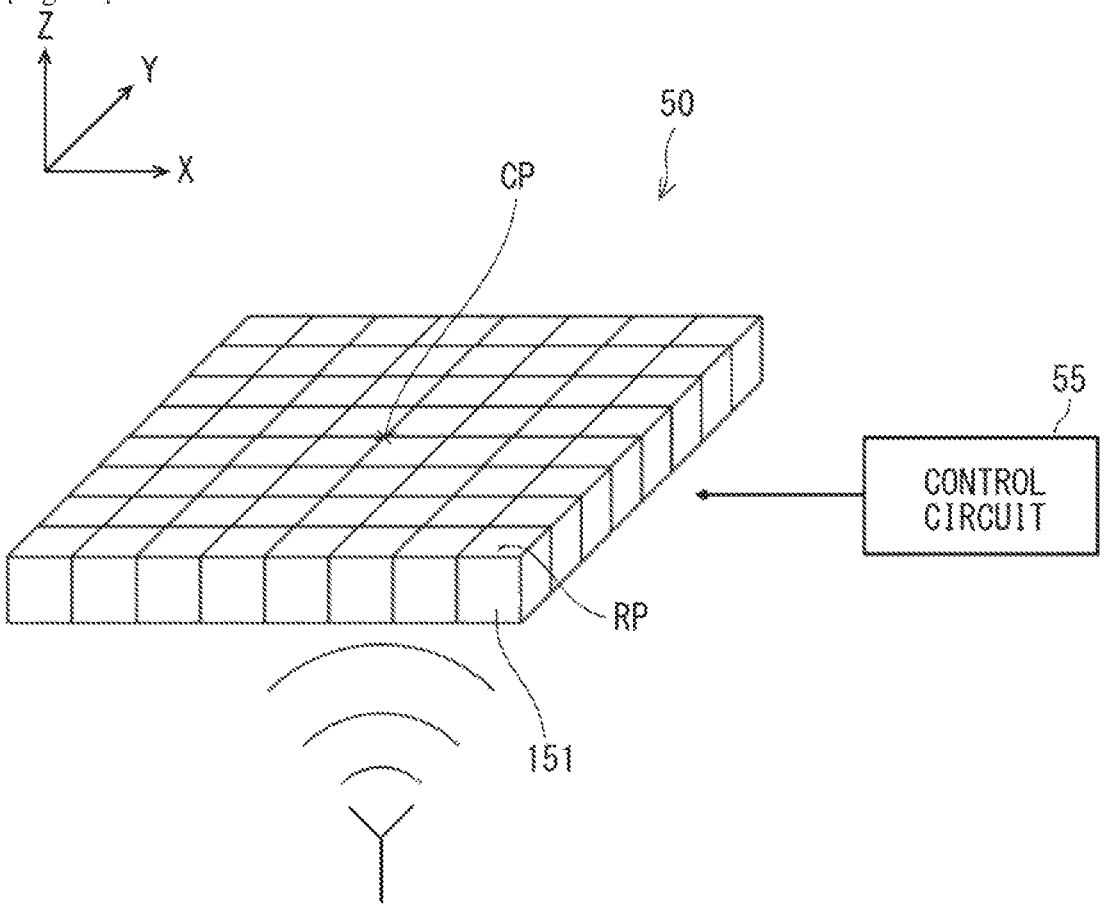

[Fig. 29]
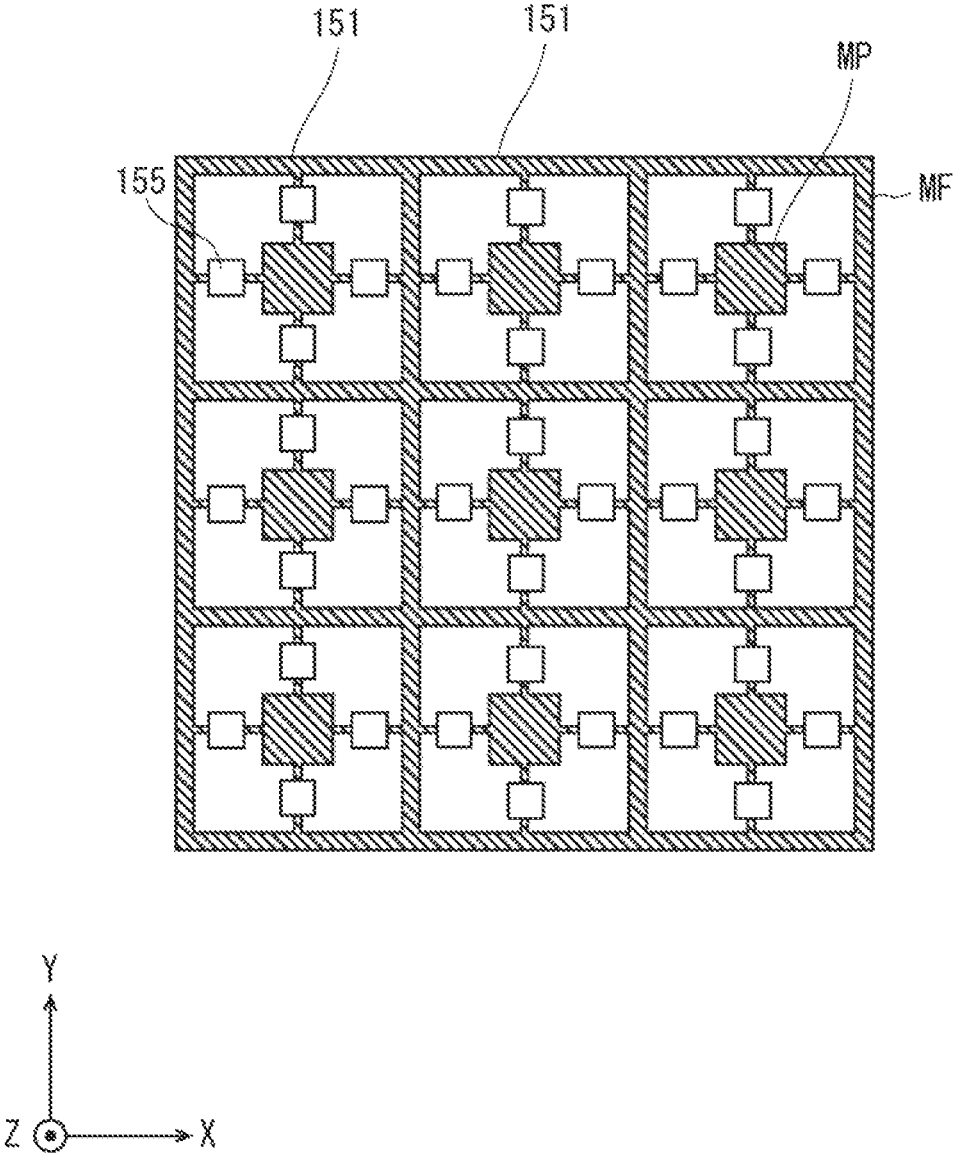

PHASE CONTROL DEVICE, ANTENNA SYSTEM, AND PHASE CONTROL METHOD

CROSS REFERENCE TO RELATED APPLICATIONS

This application is a National Stage of International Application No. PCT/JP2018/024549 filed Jun. 28, 2018.

TECHNICAL FIELD

The present disclosure relates to a phase control device, an antenna system, and a phase control method.

BACKGROUND ART

One of general phase control devices is disclosed in Patent Literature 1. The device includes a structure having a metasurface for coupling electromagnetic radiation. The structure includes a substrate component and a plurality of elements supported by the substrate component. The substrate component has a thickness no greater than a wavelength of the electromagnetic radiation. Each element has a dimension no greater than the wavelength of the electromagnetic radiation. At least two of the elements are non-identical. Elements configuration is disclosed in Patent Literature 2. Each element is designed separately, showing non-identical refraction index. An example gradient index lens for electromagnetic radiation includes a plurality of elements. Elements are arranged varying with position in the gradient index lens. The gradient index is calculated from the specifications of the equivalent dielectric lens and the operational frequency band.

CITATION LIST

Patent Literature

PTL 1: International Patent Publication No. WO2015/128657
PTL 2: U.S. Pat. No. 8,803,738

SUMMARY OF INVENTION

Technical Problem

The device disclosed in Patent Literature 1 and in Patent Literature 2 have the elements included in the structure that are sensitive to frequency. As a result, the frequency characteristic of the device varies among operational frequency band of the device.

The present disclosure has been made in view of the above-mentioned problem, and an objective of the present disclosure is to advantageously control a phase of an electromagnetic wave among target operational frequency band.

Solution to Problem

An embodiment provides a phase control device comprising a two-dimensional array of three-dimensional units and configured to shift a phase of an electromagnetic wave passing through the three-dimensional units. The two nearest three-dimensional units are configured such that the distance difference from phase center of the phase control device to the units is a wavelength of a reference frequency, and the reference frequency is higher than center frequency of operational frequency band and not higher than the highest frequency of the operational frequency band.

Further, the embodiment provides an antenna system comprising: an antenna configured to emit an electromagnetic wave; and the above-mentioned phase control device.

Further, the embodiment provides a method of shifting a phase of an electromagnetic wave comprising: a step of emitting, by an antenna, an electromagnetic wave; and a step of shifting, by the above-mentioned phase control device, the phase of the electromagnetic wave.

Advantageous Effects of Invention

According to the above embodiment, it is possible to advantageously control a phase of an electromagnetic wave with high efficiency among target operational frequency band.

BRIEF DESCRIPTION OF DRAWINGS

FIG. 1 illustrates an antenna system 1 according to a first exemplary embodiment;

FIG. 2 is a plan view of the phase control device 10 according to the first exemplary embodiment;

FIG. 3 illustrates a part 11 of the phase control device 10 according to the first exemplary embodiment;

FIG. 4 shows the configuration of two nearest cube units 102, 103 with different phase delay amount according to the first exemplary embodiment;

FIG. 5 illustrates an example of the cube unit 101 including six metal layers M according to the first exemplary embodiment;

FIG. 6 illustrates an example of equivalent permeability control with a configuration including two metal layers M1 and M2 and one dielectric layer according to the first exemplary embodiment;

FIG. 7 illustrates an example of equivalent permittivity control with a configuration including a single metal layer M according to the first exemplary embodiment;

FIG. 8 illustrates an example of a cube unit 101 according to the first exemplary embodiment;

FIG. 9 illustrates an equivalent circuit of a cube unit 101 illustrated in FIG. 8 according to the first exemplary embodiment;

FIG. 10 illustrates an example of one metal layer included in the cube units 104 according to the first exemplary embodiment;

FIG. 11 illustrates an equivalent circuit of the combination of the metal frame MF and the metal square MS according to the first exemplary embodiment;

FIG. 12 illustrates an example of a basic structure of the cube unit 104 in which six metal layers are stacked according to the first exemplary embodiment;

FIG. 13 illustrates simulation results of the cube units 104 according to the first exemplary embodiment;

FIG. 14 is a schematic of phase shift error loss against frequency according to the first exemplary embodiment;

FIG. 15 is also a schematic of phase shift error loss against frequency according to the first exemplary embodiment;

FIG. 16 illustrates simulation results of an antenna system 1 combining a slot radiation source and the phase control device 10 according to the first exemplary embodiment;

FIG. 17 illustrates a first example of a basic structure of a cube unit 105 according to a second exemplary embodiment;

FIG. 18 illustrates a second example of a basic structure of a cube unit 105 according to the second exemplary embodiment;

FIG. 19 illustrates a third example of a basic structure of a cube unit 105 according to the second exemplary embodiment;

FIG. 20 illustrates a two-dimensional equivalent circuit of the metal layers illustrated in FIGS. 17 to 19 according to the second exemplary embodiment;

FIG. 21 illustrates a fourth example of a basic structure of a cube unit 105 according to the second exemplary embodiment;

FIG. 22 illustrates a fifth example of a basic structure of a cube unit 105 according to the second exemplary embodiment;

FIG. 23 illustrates a sixth example of a basic structure of a cube unit 105 according to the second exemplary embodiment;

FIG. 24 illustrates a two-dimensional equivalent circuit of the metal layers illustrated in FIGS. 21 to 23 according to the second exemplary embodiment;

FIG. 25 illustrates another arrangement of the cube units 101 according to a third exemplary embodiment;

FIG. 26 illustrates a configuration of a phase control device 30 including hexagonal columns 111 according to the third exemplary embodiment;

FIG. 27 illustrates a configuration of a phase control device 40 including triangular columns 112 according to the third exemplary embodiment;

FIG. 28 is a schematic showing an input electromagnetic wave passing through an active phase control device 50 according to a fourth exemplary embodiment; and FIG. 29 illustrates an example of the basic structure of active three-dimensional units 151 in a single layer out of the multilayers in three-dimensional units according to the fourth exemplary embodiment.

DESCRIPTION OF EMBODIMENTS

Exemplary embodiments of present disclosure will be described below with reference to the drawings. In the drawings, the same elements are denoted by the same reference numerals, and thus a repeated description is omitted as needed.

First Exemplary Embodiment

A phase control device according to a first exemplary embodiment will be described. FIG. 1 illustrates an antenna system 1 according to the first exemplary embodiment. FIG. 2 is a plan view of the phase control device 10 according to the first exemplary embodiment.

The antenna system 1 comprises the phase control device 10 and an antenna 15. The phase control device 10 has a disk-like shape. A principal surface of the phase control device 10 is an X-Y plane in FIGS. 1 and 2. In FIG. 1, a central axis of the phase control device 10 is represented by a line CA. In FIG. 2, a center point of the phase control device 10 in the X-Y plane positioned on the central axis CA is represented by CP.

The phase control device 10 is configured to control a phase of an electromagnetic wave emitted from the antenna 15 when the electromagnetic wave passes through the phase control device 10. As illustrated FIGS. 1 and 2, one surface of the phase control device 10 faces the antenna 15. In this case, a transmission direction of the electromagnetic wave is a Z-axis direction.

When the antenna 15 is not a directional antenna, the antenna 15 isotropically emits the electromagnetic wave. Various types of antennas such as a horn antenna, a dipole antenna, a slot antenna and a patch antenna can be used as the antenna 15. Therefore, when the electromagnetic wave reaches the surface of the phase control device 10, the phase of the electromagnetic wave is not uniform on this surface of the phase control device 10. In FIG. 1, a rounded and plane surface on which the phase of the electromagnetic wave is equal are represented by a line PL. As illustrated in FIG. 1, on the surface of the phase control device 10 facing the antenna 15, the farther from the center point CP, the more the phase of the electromagnetic wave delays.

Thus, in the present exemplary embodiment, the phase control device 10 controls the phase of the electromagnetic wave in order to emit the electromagnetic wave having a phase plane perpendicular to the transmission direction. In other words, the phase plane is the X-Y plane perpendicular to the Z-axis direction.

FIG. 3 illustrates a part 11 of the phase control device 10 according to the first exemplary embodiment. The part 11 of the phase control device 10 is indicated by a numerical sign 11 in FIG. 2. The phase control device 10 includes a plurality of three-dimensional units. In this case, the three-dimensional unit is a cube unit 101. The cube units 101 are arranged in a matrix manner in the X-Y plane. In other words, the cube units 101 are arranged to constitute a two-dimensional array of cube units 101. In FIG. 3, the part 11 of the phase control device 10 is illustrated as an array of 8*8=64 cube units 101.

Note that a shape of the three-dimensional unit is not limited to the cube. As long as the three-dimensional units can be densely arranged without any space, other shapes such as a cuboid and a hexagonal column can be adopted as the shape of the three-dimensional unit.

As illustrated in FIG. 3, a reference point located at a center of each cube unit 101 in the X-Y plane is indicated by RP. Note that, for simplification, the reference point RP of only one cube unit 101 is illustrated in FIG. 3. In this case, as described above, as the distance L from the center point CP to the reference point RP (illustrated in FIG. 2) increases, the phase of the electromagnetic wave reaching the cube unit 101 from the antenna 15 delays. Therefore, the phase control device 10 is configured in such a manner that a phase delay amount of the cube unit 101 decreases as the distance L from the center point CP to the reference point RP increases in order to uniform the phase of the electromagnetic wave emitted from the surface of the phase control device 10 not facing the antenna 15.

Accordingly, the phase control device 10 focuses the electromagnetic wave emitted from the antenna 15 like a convex lens.

A size of the cube unit 101 is smaller than a wavelength of the electromagnetic wave. Therefore, the array of the cube units 101 functions as electromagnetic continuous medium. Refractive index and impedance can be controlled independently by controlling equivalent permeability and equivalent permittivity according to configurations of the cube units 101.

FIG. 4 shows the configuration of two nearest cube units 102, 103 with different phase delay amount according to the first exemplary embodiment. Other cube units of the phase control device 10 are not illustrated for simplification. Note that the phase center illustrated in FIG. 4 is a property of the designed phase control device 10. The phase center of a phase control device 10 can be considered as the focal length of an optical lens. The position of cube unit 102 can be anywhere of the phase control device 10, and the distance d between cube unit 102 and cube unit 103 are described in the following equation (1), (2):

[Math. 1]

$$d = \sqrt{\left(\sqrt{h^2 + s^2}\,\lambda_k\right)^2 - h^2 - s} \tag{1}$$

[Math. 2]

$$\lambda_k = \frac{c}{f_k} \tag{2}$$

where h indicates the vertical distance between the phase center of the phase control device 10 and the phase control device plane, $\lambda_k$ [Math. 3]

indicates the reference wavelength of electromagnetic wave, $f_k$ indicates the reference frequency, c indicates the speed of light. All cube units 101 in the phase control device 10 follow this principle.

Antenna 15 also has its phase center as a property. For an antenna 15, the phase center is the point from which the electromagnetic radiation spread spherically outward, with the phase of the electromagnetic wave being equal at any point on the sphere. When the phase control device 10 is combined with an antenna 15 as an antenna system 1, their position configuration follows the rule that the position of the phase center of both overlaps.

A basic structure of the cube unit 101 will be described. Each cube unit 101 includes at least one basic structure which comprises stacked metal layers separated from each other with at least one dielectric layer stacked between the metal layers.

FIG. 5 illustrates an example of the cube unit 101 including six metal layers M according to the first exemplary embodiment.

In FIG. 5, six metal layers M are stacked in the perpendicular direction (Z-axis direction) to the surface of the phase control device 10 (X-Y plane). The metal layer M has a square shape. The adjacent two metal layers M are insulated by at least one dielectric layer. For simplification, the dielectric layer is not illustrated in FIG. 5 and the following drawings as appropriate. In sum, the metal layers M and the dielectric layers are alternately stacked in the Z-axis direction. Thus, the cube unit 101 illustrated in FIG. 5 includes six metal layers M and five dielectric layers that are alternately stacked. Here, the metal layers M and the dielectric layers have same outer shape and same size in the X-Y plane.

The shape of the metal layer is not limited to the square shape. Another shape such as a rectangle and a round shape can be adopted. Further, the number of the metal layers and the number of the dielectric layers are not limited to those in the example of FIG. 5. Thus, the number of the metal layers may be any plural number and the number of the dielectric layers may be any number corresponding to the number of the metal layers.

The metal layer may be formed by any metal and the dielectric layer may be formed by any dielectric material. The metal layer and the dielectric layer may be formed by various manufacturing method such as vacuum deposition including chemical vapor deposition, plating and spin coating, for example.

Subsequently, control of equivalent permeability of the cube unit 101 will be described.

FIG. 6 illustrates an example of equivalent permeability control with a configuration including two metal layers M1 and M2 and one dielectric layer according to the first exemplary embodiment.

Two metal layers M1 and M2 are disposed in parallel in the Z-axis direction and the dielectric layer is interposed between the metal layers M1 and M2. When a magnetic field B having components parallel to the metal layers M1 and M2 is applied to the present configuration, a current J flows in the metal layers M1 and M2 in a direction opposite to a direction of the magnetic field B. The current J can be determined by adjusting admittance of the metal layer M. The admittance of the metal layer M is determined by the shape of the metal layer M. Therefore, by appropriately designing the shape of the metal layer M, the magnetic field B induced by the current J can be controlled so that the equivalent permeability can be controlled.

Next, control of equivalent permittivity of the cube unit 101 will be described.

FIG. 7 illustrates an example of equivalent permittivity control with a configuration including a single metal layer M according to the first exemplary embodiment.

When an electric field E having components parallel to the metal layer M is applied, a potential difference is induced between two edges E1 and E2. The current J generated by this potential difference can be determined by adjusting the admittance of the metal layer M. Therefore, by appropriately adjusting the shape of the metal layer M, the electric field E generated by the current J can be adjusted so that the equivalent permittivity can be controlled.

As described above, by appropriately designing the metal layers M, the equivalent permeability and the equivalent permittivity can be controlled. In this case, impedance Z and a phase constant $\beta$ [Math. 4]

are respectively expressed by the following formulas (3), (4):

[Math. 5]

$$Z = \frac{\mu_{equiv}}{\varepsilon_{equiv}} \tag{3}$$

[Math. 6]

$$\beta = \omega\sqrt{\mu_{equiv} \cdot \varepsilon_{equiv}} \tag{4}$$

where

[Math. 7]

$\mu_{equiv}$ indicates the equivalent permeability, $\varepsilon_{equiv}$ [Math. 8]

indicates the equivalent permittivity, and $\omega$ [Math. 9]

indicates an angular frequency of the electromagnetic wave.

Thus, it is possible to achieve arbitrary phase shift of the electromagnetic wave passing through the cube unit 101 by controlling the equivalent permittivity and the equivalent permeability. Further, no power can be theoretically reflected by designing the cube unit 101 to have the same impedance as an external environment, for example, air.

FIG. 8 illustrates an example of a cube unit 101 according to the first exemplary embodiment. The cube unit 101 includes n metal layers M1 to Mn and (n−1) dielectric layers that are alternately stacked, where n is an integer equal to or more than two.

FIG. 9 illustrates an equivalent circuit of a cube unit 101 illustrated in FIG. 8 according to the first exemplary embodiment. In FIG. 9, $Y_j$ is admittance of a j-th metal layer, $$\beta_k \quad \text{[Math. 10]}$$

is a phase constant of a k-th dielectric layer Dk, and h is a thickness of the dielectric layer, where j is an integer equal to or less than n and k is an integer equal to or less than n−1. ABCD-matrices of the metal layer and the dielectric layer can be calculated using the equivalent circuit illustrated in FIG. 9.

$$\eta_1 \ldots \eta_{n-1} \quad \text{[Math. 11]}$$

are wave impedances of dielectric layers, $$\eta_0 \quad \text{[Math. 12]}$$

is the wave impedance as an external environment, for example, air.

$$\begin{pmatrix} A & B \\ C & D \end{pmatrix} = \begin{pmatrix} 1 & 0 \\ Y_1 & 1 \end{pmatrix} \begin{pmatrix} \cos(h\beta_1) & j \\ \eta_1 & \cos(h\beta_1) \end{pmatrix} \begin{pmatrix} 1 & 0 \\ Y_1 & 1 \end{pmatrix} \begin{pmatrix} \cos(h\beta_2) & j \\ \eta_2 & \cos(h\beta_2) \end{pmatrix} \cdots \begin{pmatrix} \cos(h\beta_{n-1}) & j \\ \eta_{a-1} & \cos(h\beta_{n-1}) \end{pmatrix} \begin{pmatrix} 1 & 0 \\ Y_n & 1 \end{pmatrix} \quad (5)$$

Thus, the ABCD-matrix of the cube unit including n metal layers can be calculated and be transformed into S-parameters.

[Math. 14]

$$\begin{pmatrix} S_{11} & S_{12} \\ S_{21} & S_{22} \end{pmatrix} = \begin{pmatrix} \dfrac{B/\eta_0 - C\eta_0}{2A + B/\eta_0 + C\eta_0} & \dfrac{2}{2A + B/\eta_0 + C\eta_0} \\ \dfrac{2}{2A + B/\eta_0 + C\eta_0} & \dfrac{B/\eta_0 - C\eta_0}{2A + B/\eta_0 + C\eta_0} \end{pmatrix} \quad (6)$$

Therefore, transmittance and a phase of transmission coefficient of the present configuration can be derived. Based on these formulas, it is possible to calculate desired admittance of each metal layer which is determined by metal patterns.

Next, other shapes of the metal layers will be described in detail.

FIG. 10 illustrates an example of one metal layer included in the cube units 104 according to the first exemplary embodiment.

As illustrated in FIG. 10, the metal layer includes a metal frame MF and a metal square MS. The metal frame MF is configured as a metal closed-loop along a perimeter of the shape of the metal layer. The metal square MS is placed in an area surrounded by the metal frame MF to be insulated from the metal frame MF. Note that widths of the metal frames MF and sizes of the metal squares MS of the metal layers disposed in cube units 104 may be different from each other or the same. In this configuration, the combination of the metal frame MF and the metal square MS can be regarded as a combination of inductors L and capacitors C.

Here, it should be appreciated that, when metal patterns included in adjacent two cube units 104 are formed on the same plane, the metal patterns may be continuously formed across the border.

FIG. 11 illustrates an equivalent circuit of the combination of the metal frame MF and the metal square MS according to the first exemplary embodiment.

When a magnetic field B occurs in an X-axis direction and an electric field E appears along a Y-axis direction, metal parts in a ring shape are equivalent to inductors and gaps between metal parts separated from each other can be equivalent to capacitors. Accordingly, by designing the metal frame MF and the metal square MS, inductance and capacitance can be adjusted.

An example of a basic structure of cube units 104 will be described.

FIG. 12 illustrates an example of a basic structure of the cube unit 104 in which six metal layers are stacked and separated with each other with five dielectric layers stacked between the metal layers according to the first exemplary embodiment. In this example, the metal layers have the same outer shape as the metal layer illustrated in FIG. 10.

Phase shift due to the cube units 104 illustrated in FIG. 12 will be described.

FIG. 13 illustrates simulation results of the cube units 104 according to the first exemplary embodiment.

In this simulation, a phase shift range is adjustable according to a size of the metal square MS and a size of the metal frame MF. As illustrated in FIG. 13, six cube units are designed, achieving a whole phase shift range from −180 to 180 degree with high efficiency. In other words, the basic structures are configured to cover all of the phase shift range. It is shown in FIG. 13 that operational frequency band in this first embodiment is set from $f_l$ to $f_h$.

Further, efficiency of the phase control device 10 among operational frequency band is modelled using formula (7):

[Math. 15]

$$L_{All} = L_{CU} + L_{DL} + L_{PD} \quad (7)$$

where $L_{All}$ indicates the overall loss of power when an electromagnetic wave transmitting through the phase control device 10, $L_{CU}$ indicates the loss of cube units 104, $L_{DL}$ indicates the loss of dielectric materials, $L_{PD}$ indicates the loss of phase shift error, in other words, the loss coming from the difference between required phase shift value at a position on the phase control device 10 and the provided phase shift value of cube unit 104.

It can be easily understood that, since the configuration of cube units 104 are designed with reference frequency $f_k$, there is no phase shift error only at the reference frequency $f_k$.

FIG. 14 is a schematic of phase shift error loss against frequency according to the first exemplary embodiment.

As illustrated in FIG. 14, the phase shift error loss is proportional to the frequency difference from the reference frequency $f_k$.

FIG. 15 is also a schematic of phase shift error loss against frequency according to the first exemplary embodiment.

The reference frequency $f_k$ is higher than the center frequency $f_c$ of operational frequency band and not higher than the highest frequency $f_k$ of operational frequency band. In other words, the configuration of cube units 104 of the phase control device 10 follows the rule that the distance between two nearest cube units is shorter than that calculated using the center frequency $f_c$ of operational frequency band as the reference frequency $f_k$ in formula (1)(2). The two nearest cube units having same phase shift coverage are configured such that the distance difference from phase center of the phase control device 10 to the units is a wavelength of a reference frequency $f_k$. Since the loss of cube units 104 are designed to be uniform in operational frequency band, and dielectric material tends to have higher loss at higher frequency, this configuration of cube units 104 of the phase control device 10 is able to utilize the phase shift error to balance the non-uniform loss caused by dielectric material and cube units 104. So that the described configuration of phase control device 10 can achieve a required plain gain frequency response at operational frequency band.

FIG. 16 illustrates simulation results of an antenna system 1 combining a slot radiation source and the phase control device 10 according to the first exemplary embodiment.

Note that the operational frequency band is $f_l$ to $f_h$. Two phased control device with same cube unit pattern but different cube units configuration rules are designed. One is using the center frequency $f_c$ as the reference frequency $f_k$, which is a common configuration structure in previous works. The other is using the highest frequency $f_h$ as the reference frequency $f_k$ as described above. It can be understood the described configuration achieves the expected gain frequency response: highest gain near the center of operational frequency band.

As described above, according to the present configuration, it is possible to realize the phase control device capable of achieving a highest gain at the center of operational frequency band by combining the three-dimensional units having different coverage of the phase shift range, especially, by arranging the cube units with a reference frequency $f_k$ higher than the center frequency $f_c$ but not higher than the highest frequency $f_h$ of operational frequency band, in other words, by combining the cube units with a shorter distance between two nearest same cube units having same coverage of the phase shift range.

Note that the phase control device 10 described with reference to FIG. 1 is merely an example. The phase control device may be configured in such a manner that a phase delay amount of the cube unit 101 increases as the distance L from the center point CP to the reference point RP increases. In this case, the phase control device 10 may be configured to diffuse the electromagnetic wave like a concave lens according to usage of the electromagnetic wave by appropriately designing the cube units 101 serving as the three-dimensional units.

Further, the transmission direction of the electromagnetic wave emitted from the antenna 15 and reaching the phase control device 10 is not limited to the direction (Z-axis direction) perpendicular to the surface (X-Y plane) of the phase control device 10. The transmission direction of the electromagnetic wave emitted from the antenna 15 and reaching the phase control device 10 may be tilted with respect to the direction (Z-axis direction) perpendicular to the surface (X-Y plane) of the phase control device 10.

Additionally, the transmission direction of the electromagnetic wave emitted from the phase control device 10 is not limited to the direction (Z-axis direction) perpendicular to the surface (X-Y plane) of the phase control device 10. The transmission direction of the electromagnetic wave emitted from the phase control device 10 may be tilted with respect to the direction (Z-axis direction) perpendicular to the surface (X-Y plane) of the phase control device 10 by appropriately designing the cube units 101 serving as the three-dimensional units.

Second Exemplary Embodiment

In a second exemplary embodiment, some examples of a basic structure of three-dimensional units will be described. In examples of the present exemplary embodiment, metal layers of nine cube units are illustrated in the drawings and a border between the cube units is indicated by a dashed line.

FIG. 17 illustrates a first example of a basic structure of a cube unit 105 according to the second exemplary embodiment.

In this example, a cross-shape metal M11 in which one metal line extending along the X-axis direction and the other metal line extending along Y-axis direction intersect with each other at the reference point RP is disposed in a cube unit 105. Further, four metal tips are respectively disposed at the ends of the crossed metal lines so as to extend directions orthogonal to the lines.

FIG. 18 illustrates a second example of a basic structure of a cube unit 105 according to the second exemplary embodiment. In this example, a square ring-shape metal M12 is disposed in a metal layer in a cube unit 105.

FIG. 19 illustrates a third example of a basic structure of a cube unit 105 according to the second exemplary embodiment. In this example, an island-shape metal M13 is disposed in a metal layer in a cube unit 105.

In the first to third examples, the X-axis is the direction of the electric field E, for example. It should be appreciated that the metal layers of the first to third examples can be configured to operate in the same manner, even when the direction of the electric field E is in any direction within the X-Y plane.

FIG. 20 illustrates a two-dimensional equivalent circuit of the metal layers illustrated in FIGS. 17 to 19 according to the second exemplary embodiment.

As illustrated in FIG. 20, the two-dimensional equivalent circuit can be represented by four pairs of an inductor L1 and a capacitor C1. In one pair, one end of the inductor L1 is connected to one end of the capacitor C1. The other ends of the inductors L1 of the four pairs are connected to each other.

Further, other examples of basic structures of the three-dimensional units will be described. The metal layers described below are configured to constitute parallel resonance circuits.

FIG. 21 illustrates a fourth example of a basic structure of a cube unit 105 according to the second exemplary embodiment. In this example, in a cube unit 105, a cross-shape metal M11 illustrated in FIG. 17 is surrounded by a metal frame MF that is a square ring-shaped metal.

FIG. 22 illustrates a fifth example of a basic structure of a cube unit 105 according to the second exemplary embodiment. In this example, in a cube unit 105, a square ring-shape metal M12 illustrated in FIG. 18 is surrounded by a metal frame MF that is a square ring-shaped metal.

FIG. 23 illustrates an sixth example of a basic structure of a cube unit 105 according to the second exemplary embodiment. In this example, in a cube unit 105, the island-shape metal M13 illustrated in FIG. 19 is surrounded by a metal frame MF that is a square ring-shaped metal.

In the fourth to sixth examples, the metal frames MF of the metal layers are connected and integrated as one metal part. The X-axis is the direction of the electric field E, for example. It should be appreciated that the metal layers illustrated in FIGS. 21 to 23 can be configured to operate in the same manner, even when the direction of the electric field E is in any direction within the X-Y plane.

FIG. 24 illustrates a two-dimensional equivalent circuit of the metal layers illustrated in FIGS. 21 to 23 according to the second exemplary embodiment. The metal layers illustrated in FIGS. 21 to 23 function as parallel resonance circuits.

The equivalent circuit has a configuration in which the inductors L2 are added to the equivalent circuit illustrated in FIG. 20. The inductors L2 are formed by the metal frame MF. In this circuit, two inductors L2 are inserted between the other ends of two capacitors C1. Thus, the equivalent circuit is represented as a circuit in which eight inductors L2 are added to the equivalent circuit illustrated in FIG. 20.

As described above, the above metal layers of the first to sixth examples can be represented by the equivalent circuits with the inductors L and capacitors C. Therefore, it is possible to adjust equivalent permittivity and equivalent permeability of the three-dimensional unit as in the first exemplary embodiment.

As a result, according to the present configuration, it is possible to realize the phase control device capable of achieving arbitrary phase shift with high efficiency by combining the three-dimensional units having different coverage of the phase shift range.

Third Exemplary Embodiment

In a third exemplary embodiment, other arrangements of the three-dimensional units will be described.

FIG. 25 illustrates another arrangement of the cube units 101 according to the third exemplary embodiment.

In FIG. 25, a phase control device 20 includes a plurality of rows 21 densely arranged in the Y-axis direction without any spaces. The row 21 includes a plurality of cube units 101 densely arranged in the X-axis direction without any spaces. The adjacent two rows 21 are shifted in the X-axis direction by half of a width of the cube unit 101. Since the cube units 101 serving as the three-dimensional units are densely arranged without any spaces, the phase control device 20 can control the phase of the electromagnetic wave in the same manner as the phase control device 10 according to the first embodiment.

It should be appreciated that a plurality of cube units 101 may be densely arranged in the Y-axis direction without any spaces to constitute a row and the rows may be densely arranged in the X-axis direction.

Another configuration will be described.

FIG. 26 illustrates a configuration of a phase control device 30 including hexagonal columns 111 according to the third exemplary embodiment.

In this configuration, the hexagonal column 111 is a basic structure of the three-dimensional unit. The hexagonal column 111 includes a plurality of the metal layers and the dielectric layers interposed therebetween. As illustrated in FIG. 26, the hexagonal columns 111 are densely arranged without any spaces to constitute a so-called honeycomb structure. Since the hexagonal column 111 are densely arranged without any spaces, the phase control device 30 can control the phase of the electromagnetic wave in the same manner as the phase control device 10 according to the first embodiment.

Further configuration will be described.

FIG. 27 illustrates a configuration of a phase control device 40 including triangular columns 112 according to the third exemplary embodiment.

In this configuration, the triangular column 112 is a basic structure of the three-dimensional unit. The triangular column 112 includes a plurality of the metal layers and the dielectric layers interposed therebetween. As illustrated in FIG. 27, a plurality of the triangular columns 112 are densely arranged without any spaces. Since the triangular columns 112 are densely arranged without any spaces, the phase control device 40 can control the phase of the electromagnetic wave in the same manner as the phase control device 10 according to the first embodiment.

As described above, the above three-dimensional units according to the present exemplary embodiment can be densely arranged without any spaces. Therefore, it is possible to adjust equivalent permittivity and equivalent permeability of the three-dimensional unit as in the first exemplary embodiment.

As a result, according to the present configuration, it is possible to realize the phase control device capable of achieving arbitrary phase shift with high efficiency in operational frequency band by combining the three-dimensional units having different coverage of the phase shift range.

Fourth Exemplary Embodiment

In a fourth exemplary embodiment, an antenna system comprising an active phase control device will be described.

FIG. 28 is a schematic showing an input electromagnetic wave passing through an active phase control device 50 according to the fourth exemplary embodiment.

A control circuit 55 provides a control signal for bias device (not shown) within the active phase control device 50, allowing tuning or selecting a desired property of the active phase control device 50.

The active phase control device 50 illustrated in FIG. 28 includes a plurality of three-dimensional units. In this case, the three-dimensional unit is an active cube unit 151. Active cube units 151 have same basic structure comprising a bias device. Bias devices are separately connected to an electronic circuit 55. The output bias voltage of each bias device is separately controlled using electronic control signal given by the electronic circuit 55. By sending a range of control signals, the equivalent permeability and permittivity of active cube unit 151 can be controlled. So that every active cube unit 151 within the active phase control device 50 is able to cover the full phase shift range with high efficiency when a proper bias voltage is given. Refractive index and impedance also can be controlled independently by controlling equivalent permeability and equivalent permittivity. A refractive index, a permeability and a permittivity are adjustable properties of the active cube unit 151. The operational frequency band has a plurality of characteristics including a high frequency point, a center frequency point, a low frequency point, a peak gain frequency point, and half power bandwidth, and at least one of the plurality of characteristics is changed using the adjustable property.

FIG. 29 illustrates an example of the basic structure of active three-dimensional units 151 in a single layer out of the multilayers in three-dimensional units according to the fourth exemplary embodiment.

Varactor diodes 155 are implemented between the patch metal MP and metal frame MF of the two-dimensional array. Since the patch MP connected to bias lines through via, and the metal frame MF works as a ground plane, so the varactor diodes 155 in each three-dimensional unit 151 can be independently controlled by control signals applied on bias lines. As a result, the equivalent permeability and equivalent permittivity are able to be controlled to add an arbitrary phase shift to the electromagnetic wave with high efficiency.

Note that the basic structure of the active three-dimensional units is not restricted to the one illustrated in FIG. 29, other possible components like liquid crystal or MEMS are possible basic structure of active three-dimensional units.

In this exemplary embodiment, the active phase control device 50 having two operational modes is explained. Two different operational center frequencies are selected.

In the first operational mode having a first operational frequency band which is adjustable using the electronic control signal, the reference frequency $f_k$ is equal to the first operational center frequency, which means all active cube units 151 are configured that any two active cube units 151 have same phase shift value if the distance difference from phase center to these two active cube units 151 is a wavelength of the first operational center frequency. In other words, the control signal is configured as a first operational mode such that any two active cube units 151 receive same electronic control signal (same output bias voltage) if the distance difference from phase center to these two active cube units 151 is a wavelength of the first operational center frequency. As a result, the antenna 1 system is able to achieve such a gain frequency response that the peak gain is at the first operational center frequency.

In the second operational mode having a second operational frequency band which is higher than the first operational frequency band and is also adjustable using the electronic control signal, the reference frequency $f_k$ is equal to the second operational center frequency, which means all active cube units 151 are configured that any two active cube units 151 have same phase shift value if the distance difference from phase center to these two active cube units 151 is a wavelength of the second operational center frequency. In other words, the control signal is configured as a second operational mode such that any two active cube units 151 receive same output bias voltage if the distance difference from phase center to these two active cube units 151 is a wavelength of the second operational center frequency. As a result, the antenna system is able to achieve such a gain frequency response that the peak gain is at the second operational center frequency.

By applying the abovementioned two operational modes of control signal, it is possible to dynamically control the gain frequency response of the antenna system 1. Note that the number of operational modes of the antenna system is not limited to two.

Other Embodiment

Note that the present disclosure is not limited to the above exemplary embodiments and can be modified as appropriate without departing from the scope of the disclosure. For example, the shapes of the three-dimensional units arranged in the phase control device are not limited to one shape. Thus, as long as the three-dimensional units can be densely arranged without any spaces and desired phase control can be achieved, various shapes such as the hexagonal column and the triangular column described above, a cube, and a cuboid can be combined to constitute the array of the three-dimensional units.

In the exemplary embodiment described above, the phase control device has configured as a disk-like shape device. However, the shape of the phase control device is not limited to this. For example, the phase control device may be configured as a board-like shape device other than the disk-like shape device.

While the present disclosure has been described above with reference to exemplary embodiments, the present disclosure is not limited to the above exemplary embodiments. The configuration and details of the present invention can be modified in various ways which can be understood by those skilled in the art within the scope of the disclosure.

REFERENCE SIGNS LIST

1 ANTENNA SYSTEM
10, 20, 30, 40 PHASE CONTROL DEVICE
15 ANTENNA
50 ACTIVE PHASE CONTROL DEVICE
55 CONTROL CIRCUIT
101 TO 105 CUBE UNIT
151 ACTIVE CUBE UNIT
155 VARACTOR DIODE
C, C1 CAPACITOR
CA CENTRAL AXIS
CP CENTER POINT
D1 TO DN-1 DIELECTRIC LAYER
L, L1, L2 INDUCTOR
M, M1 TO MN METAL LAYER
M11 CROSS-SHAPE METAL
M12 RING-SHAPE METAL
M13 ISLAND-SHAPE METAL
MF METAL FRAME
MP PATCH METAL
MS SQUARE METAL
RP REFERENCE POINT

The invention claimed is:

1. A phase control device comprising a two-dimensional array of three-dimensional units and configured to shift a phase of an electromagnetic wave passing through the three-dimensional units, wherein a nearest two of the three-dimensional units are configured such that a distance difference from a phase center of the phase control device to the units is a wavelength of a reference frequency, and the reference frequency is higher than a center frequency of an operational frequency band and not higher than a highest frequency of the operational frequency band.

2. The phase control device according to claim 1, wherein each three-dimensional unit includes at least one basic structure, each basic structure comprises stacked metal layers separated from each other with at least one dielectric layer stacked between the metal layers, and the metal layer and the dielectric layer are configured to have a same outer shape and a same size so as to be capable of being densely arranged into a two-dimensional array without any spaces.

3. The phase control device according to claim 2, wherein the basic structures are configured to cover all of a phase shift range.

4. The phase control device according to claim 1, wherein a delay amount of the phase of the electromagnetic wave passing through each three-dimensional unit increases or decreases as a distance from a center of the two-dimensional array to the each three-dimensional unit increases.

5. The phase control device according to claim 1, wherein the phase control device is an active phase control device, each of the three-dimensional units is an active three-dimensional unit, the active three-dimensional units have an adjustable property, the operational frequency band has a plurality of characteristics including a highest frequency point, a center frequency point, a low frequency point, a peak gain frequency point, and a half power bandwidth, and at least one of the plurality of characteristics can be changed using the adjustable property of the active three-dimensional units.

6. The phase control device according to claim 5, further comprising an electronic circuit operable to provide electronic control signals to the active three-dimensional units, the active three-dimensional units are independently controlled by the electronic control signals, and the signals are configured such that two of the active three-dimensional units receive a same signal when the distance difference from the phase center to the two of the active three-dimensional units is a wavelength of the reference frequency.

7. The phase control device according to claim 5, wherein the adjustable property is a refractive index.

8. The phase control device according to claim 5, wherein the adjustable property is a permeability and a permittivity.

9. The phase control device according to claim 5, wherein the active phase control device has a first operational mode having a first operational frequency band, and a second operational mode having a second operational frequency band, the second operational frequency band is higher than the first operational frequency band, and the operational frequency band is adjustable using an electronic control signal.

10. The phase control device according to claim 5, wherein each active three-dimensional unit includes a bias device, an output bias voltage of the bias device is controlled using an electronic control signal, and the active three-dimensional units are able to cover all of a phase shift range with a range of the bias voltage.

11. An antenna system comprising:

an antenna configured to emit an electromagnetic wave; and the phase control device according to claim 1.

12. A method of shifting a phase of an electromagnetic wave comprising:

a step of emitting, by an antenna, an electromagnetic wave; and a step of shifting, by the phase control device according to claim 1, the phase of the electromagnetic wave.

* * * * *